US009446585B2

(12) United States Patent
Goyal et al.

(10) Patent No.: US 9,446,585 B2
(45) Date of Patent: Sep. 20, 2016

(54) METHODS AND APPARATUS FOR HANDHELD INKJET PRINTER

(71) Applicants: Pragun Goyal, Cambridge, MA (US); Amit Zoran, Jerusalem (IL); Joseph Paradiso, Arlington, MA (US)

(72) Inventors: Pragun Goyal, Cambridge, MA (US); Amit Zoran, Jerusalem (IL); Joseph Paradiso, Arlington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 14/833,127

(22) Filed: Aug. 23, 2015

(65) Prior Publication Data

US 2016/0052261 A1 Feb. 25, 2016

Related U.S. Application Data

(60) Provisional application No. 62/040,589, filed on Aug. 22, 2014.

(51) Int. Cl.
*B41J 2/045* (2006.01)
*B41J 3/36* (2006.01)

(52) U.S. Cl.
CPC ..... *B41J 2/04586* (2013.01); *B41J 3/36* (2013.01)

(58) Field of Classification Search
CPC ..... B41J 2/04505; B41J 2/04586; B41J 3/36
See application file for complete search history.

(56) References Cited

U.S. PATENT DOCUMENTS 5,988,900 A * 11/1999 Bobry ..... B41J 3/39 346/143
6,312,124 B1 11/2001 Desormeaux
7,453,586 B2 11/2008 Silverbrook et al.
7,654,665 B2 * 2/2010 Gray ..... B41J 3/36 346/143
7,682,017 B2 3/2010 Reed et al.
7,787,145 B2 8/2010 Robertson et al.
7,812,994 B2 10/2010 Carlson et al.
7,944,580 B2 5/2011 Carlson et al.
8,011,782 B2 9/2011 Silverbrook et al.
8,079,765 B1 12/2011 Bledsoe et al.
8,083,422 B1 12/2011 Simmons et al.
8,092,006 B2 1/2012 Brown et al.
8,240,801 B2 * 8/2012 Bledsoe ..... B41J 3/36 347/109
8,308,269 B2 * 11/2012 Omer ..... B41J 2/165 347/20
8,717,617 B1 5/2014 Mealy et al.
2006/0165460 A1 7/2006 Breton
2008/0231682 A1 9/2008 Grandeza et al.

OTHER PUBLICATIONS

Brox, T., et al., High Accuracy Optical Flow Serves 3-D Pose Tracking: Exploiting Contour and Flow Based Constraints; published in Computer Vision—ECCV 2006, Proceedings of 9th European Conference on Computer Vision, Graz, Austria, May 7-13, 2006, pp. 98-111.
Polhemus, Fastrak the Fast and Easy Digital Tracker, 2008.
Rivers, A., et al., Position-correcting tools for 2D digital fabrication; published in ACM Transactions on Graphics (TOG), Proceedings of ACM SIGGRAPH 2012, vol. 31, Issue 4, Jul. 2012, Article No. 88, ACM New York, NY, USA.
Song, H., et al., The ModelCraft framework: Capturing freehand annotations and edits to facilitate the 3D model design process using a digital pen; published in ACM Transactions on Computer-Human Interaction (TOCHI),vol. 16, Issue 3, Sep. 2009, Article No. 14, ACM New York, NY, USA.

* cited by examiner

*Primary Examiner* — Thinh Nguyen
(74) *Attorney, Agent, or Firm* — Stephen R. Otis

(57) ABSTRACT

A handheld inkjet printer includes an inkjet print head and a tip. One or more sensors measure the position of points on a curved surface that are physically touched by the tip while the tip is moved relative to the surface. Based on these measurements, a computer generates or modifies a computer model that specifies at least (i) position of the curved surface, and (ii) a target region of the curved surface on which a pattern is to be printed. In addition, the one or more sensors measure position and orientation of nozzles in the print head, while the handset is moved relative to the surface. The computers also calculate, based on the computer model and these additional measurements, which of the nozzles to fire at a different times, such that the pattern is printed on the target region as the handset is moved relative to the surface.

20 Claims, 15 Drawing Sheets

METHODS AND APPARATUS FOR HANDHELD INKJET PRINTER

RELATED APPLICATIONS

This application is a non-provisional of, and claims the benefit of the filing date of, U.S. Provisional Patent Application No. 62/040,589, filed Aug. 22, 2014, the entire disclosure of which is herein incorporated by reference.

FIELD OF TECHNOLOGY

The present invention relates generally to inkjet printers.

SUMMARY

In illustrative implementations of this invention, a handheld inkjet printer prints on a 3D surface, such as a curved surface. The handheld printer is part of a printing system that (i) measures the position and shape of the 3D surface, (ii) generates or modifies a computer model of the surface, and (iii) uses the computer model to control printing of a pattern on the surface.

In an illustrative implementation of this invention, a user holds a handheld printer and presses a tip of the printer against a 3D curved surface, while moving the tip along the surface. As the tip is pressed against and moved across the surface, one or more sensors measure the position of points on the surface. A computer calculates a point cloud that represents the measured position of these points on the surface. The computer uses this point cloud to generate or modify a computer model of the surface. The computer determines where on the surface to print a desired pattern—that is, determines a target region of the surface on which a pattern is to be printed.

The computer model is then used to control printing on the 3D curved surface. The handheld inkjet printer includes a print head. During print mode, one or more sensors take measurements, from which a computer estimates the position and orientation of nozzles in the print head relative to the curved surface. In some cases, a computer determines, for each nozzle in the print head, whether the following three conditions are satisfied: (1) the nozzle is in a position and orientation relative to the curved surface, such that if ink were ejected from the respective nozzle, the ink would impact a point in the target region, (2) the distance from the respective nozzle to the point is less than a threshold distance, and (3) ink has not yet been applied to the point by the apparatus. In some cases, if these three conditions are satisfied, the computer outputs control signals to cause the respective nozzle to eject ink. These measurements and computer determinations are repeated, as the user moves the handheld printer to different positions relative to the curved surface.

The user moves the handheld printer freely, and is not constrained to follow any particular trajectory relative to the 3D curved surface. The inkjet nozzles fire selectively (e.g., in some cases, when the three conditions specified above are satisfied). The user moves the handheld inkjet printer relative to the curved surface, such that printer moves through appropriate positions to print all of the points of the target region. The result is that the entire target pattern is printed on the target region of the curved surface.

An advantage of the handheld printer, in illustrative implementations, is that it enables a seamless workflow with a two-way transfer of information. Specifically, information flows in at least two directions: (1) from a curved or planar surface of a workpiece to a computer, and (2) from the computer to the surface. Data flows from the surface to the computer when the digitizer tip of the handheld printer is pressed against the surface and the handheld printer measures position of points on the surface. This data is imported to a computer, where it is used to create or revise a computer model of the surface. Data flows from the computer to the surface when the handheld printer prints a pattern on the surface, in accordance with the computer model.

Another advantage of the handheld printer, in illustrative implementations, is its ability to print on curved surfaces. For example, in some cases, the printing system takes a planar target pattern as an input, fits the planar pattern to a model of a curved surface, and controls printing by the handheld printer such that the target pattern is printed without distortion on the actual curved surface. The system detects the position and orientation of nozzles of the print head relative to the surface, and fires the nozzles only when they pointed toward, and within a specified distance from, the target region.

The handheld printer is also able to print on a planar surface or a surface with planar facets, such as a 3D surface that includes multiple planar facets with different normal vectors.

In some implementations, a computer maintains at least a partial computer model of the work piece and a raster graphic to be imprinted onto the work piece. The computer computes the nozzle trajectories for each nozzle on the print head based on the position and orientation of the device, and determines which nozzles of the print head to fire. The computer tracks the amount of ink applied to different parts of the work piece. In some cases, the ink is applied evenly on the work piece.

In some implementations, the handheld printer is mounted with inertial sensors (e.g., accelerometers, gyroscope, and magnetometer) to sense user gesture as the user uses the device. This gesture data is used to dynamically change a local raster pattern for a location (e.g., the location on which the device is currently printing). In an illustrative use case, a user artistically modifies a target pattern by making gestures that cause a computer to modify a local raster pattern.

In some implementations, buttons mounted on the handheld printer receive user input during the operating mode of the device. The buttons allow the user to over-ride the computer control of the print-head while the button is depressed or the over-ride mode is activated.

In some implementations, a set of cameras are external to, and separate from the handheld printer. The cameras track the position of visual markers on the handheld printer, in order to estimate position and orientation of the handheld printer. When the handheld printer is in digitizer mode, the cameras track the position of the visual markers (and thus position and orientation of the handheld printer) in order to measure the position of points on a curved surface while a digitizer tip of the handheld printer is pressed against, and moved relative to, the curved surface.

In some implementations, active or passive magnetic tracking estimates the position and orientation of the handheld device.

In some embodiments, a differential displacement sensor is used in conjunction with the magnetic tracking for this estimation. For example, in some cases: (a) the differential displacement sensor comprises an optical flow sensor that measures changes in position of the optical flow sensor relative to the 3D curved surface; (b) the magnetic tracking sensor includes a transmitter and receiver; (c) the transmitter is rigidly attached to a workbench or to another object that is stationary during operation of the printer; (f) the receiver is mounted in the handheld printer; (g) the magnetic tracking measures the position of the receiver relative to the transmitter.

In some embodiments, a computer performs a state estimation algorithm, in order to iteratively estimate position or orientation of the handheld printer. For example, in some cases, a computer performs a Kalman filter algorithm, in order to iteratively estimate the position or orientation of nozzles of the print head. In the Kalman filter algorithm, measurements taken by the differential displacement sensor are used in a propagation step and measurements taken by an absolute position sensor (e.g., an optical tracking system or magnetic tracking system) are used in an update step. In some implementations, a Kalman filter algorithm is used, and the differential displacement measurements are taken more frequently than the magnetic tracking sensor measurements. An advantage of doing so is that, in some cases, it is less expensive to achieve a high sampling rate with a differential displacement sensor (such as an optical flow sensor) than with an absolute position sensor (e.g., a magnetic tracking system or optical tracking system). Increasing the sampling rate at which measurements of the position of the nozzles are taken tends to improve the accuracy of the printing.

In some embodiments, a camera mounted on a handheld printer detects features of the work piece and uses this to estimate the position of the device in reference to the detected features. In some embodiments, specifically designed marks on the work piece are sensed by the device optically.

In some embodiments, a proximity sensor is employed to estimate distance from the work piece. In some embodiments, visual and haptic feedback convey to the user an estimate of the device's distance from the work piece. In some embodiments, roller wheels mounted on the printing face of the device assist a user in maintaining a consistent printing distance from the work piece. In another embodiment the roller wheels are steered by the computer program so as to provide haptic feedback to the user about the direction in which the handheld printer should be moved.

In some cases, the handheld printer includes a digitizer tip for creating a point-cloud for the work piece. A computer fits a computer model to the point-cloud for a better and complete representation of the work piece.

In some cases, the point-cloud is used to estimate the position of a work piece in the reference frame of the tracking system by best fitting an already existing computer model for the work piece to the point-cloud data. In some cases, the digitizer tip is used to measure features on the work piece. A computer uses data that represents these measured features, in order to further build on the computer model.

In illustrative implementations, any type of inkjet printing technology may be employed. For example, in some cases, piezoelectric or thermoelectric components actuate ejection of ink from the inkjet print head.

The description of the present invention in the Summary and Abstract sections hereof is just a summary. It is intended only to give a general introduction to some illustrative implementations of this invention. It does not describe all of the details and variations of this invention. Likewise, the descriptions of this invention in the Field of Technology section are not limiting; instead they identify, in a general, non-exclusive manner, a field of technology to which exemplary implementations of this invention generally relate. Likewise, the Title of this document does not limit the invention in any way; instead the Title is merely a general, non-exclusive way of referring to this invention. This invention may be implemented in many other ways.

The above Figures show some illustrative implementations of this invention, or provide information that relates to those implementations. However, this invention may be implemented in many other ways.

DETAILED DESCRIPTION

In illustrative implementations of this invention, a handheld inkjet printer facilitates a two-way flow of information between a physical 3D curved surface and a computer model. First, when the printer is in digitizer mode, a digitizer tip of the handheld printer is used to measure the 3D curved surface. These measurements are used to generate or modify a computer model of the 3D curved surface. Second, when the printer is in print mode, sensors detect position and orientation of the handheld inkjet printer. A computer compares the measured orientation and position of the handheld printer to the position of points on a 3D curved surface of a workpiece, in order to control printing by the handheld printer onto the 3D curved surface. Thus, the handheld printer may be used to effectively transfer reference marks from a computer model to the workpiece. By allowing for this two-way exchange of information between the computer model and the workpiece, the handheld printer facilitates the inclusion of computer assisted design (CAD) in manual fabrication workflows.

Drawings

In the example shown in FIGS. 1A, 1B, 1C and 1D, a printing system employs a magnetic tracking system to measure absolute position and absolute orientation of a handheld printer. Alternatively or in addition, other sensors (such as a 3D or 6D optical tracker) may be used to track absolute position and absolute orientation of the handheld inkjet printer.

Figure 1A:
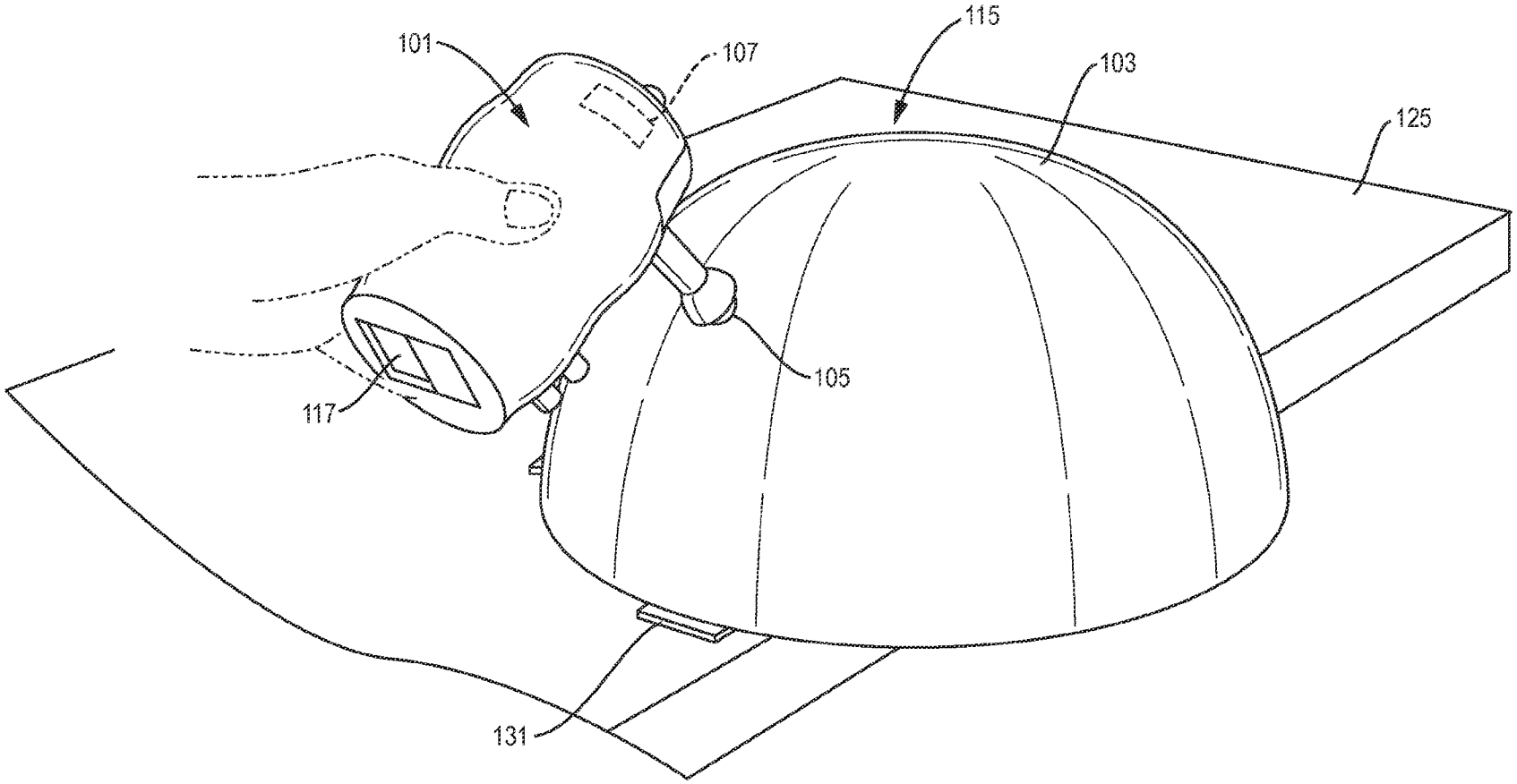
FIG. 1A shows a handheld inkjet printer measuring the position of points on a curved surface.

FIG. 1A shows a handheld inkjet printer 101 measuring the position of points on a curved surface 103 of a workpiece 115, in an illustrative implementation of this invention. A user holds an inkjet printer 101. The printer 101 includes a protuberance (a "digitizer tip") 105. The user holds the printer 101 such that the digitizer tip 105 is physically touching the surface 103 while the user moves the digitizer tip 105 to different positions on the surface 103.

A magnetic tracking system ("MTS") includes a magnetic field generator 167 (shown in FIG. 3) and a magnetic receiver 107. The receiver 107 is housed onboard the handheld printer 101. The magnetic field generator 167 is sometimes referred to herein as a transmitter.

The MTS takes measurements of the position of the magnetic receiver 107 in a magnetic field, as the user moves the handheld printer 101 to different positions, while the digitizer tip 105 physically touches the surface 103.

The magnetic receiver 107 is at a known offset from the digitizer tip 105. Thus, the position of magnetic receiver 107 maps to the position of the digitizer tip 105, which in turn maps to the position of a point on the surface 103 touched by the digitizer tip 105.

Figure 3:
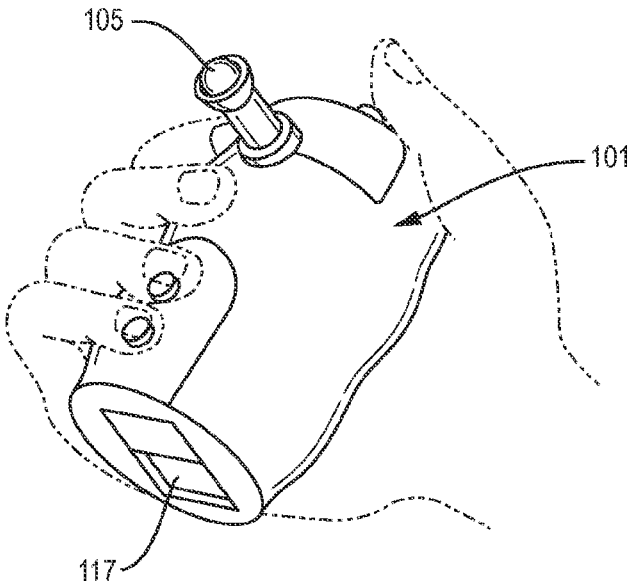
FIG. 3 shows an example of a handheld inkjet printer.

Data indicative of the measurements taken by the magnetic receiver is sent to one or more computers (e.g., 109 or 169, shown in FIG. 3). The one or more computers perform an algorithm that takes the data as input and that calculates a point-cloud that represents the 3D spatial position of points on the surface 103 which were touched by the digitizer tip 105 during the measurements.

Figure 1B:
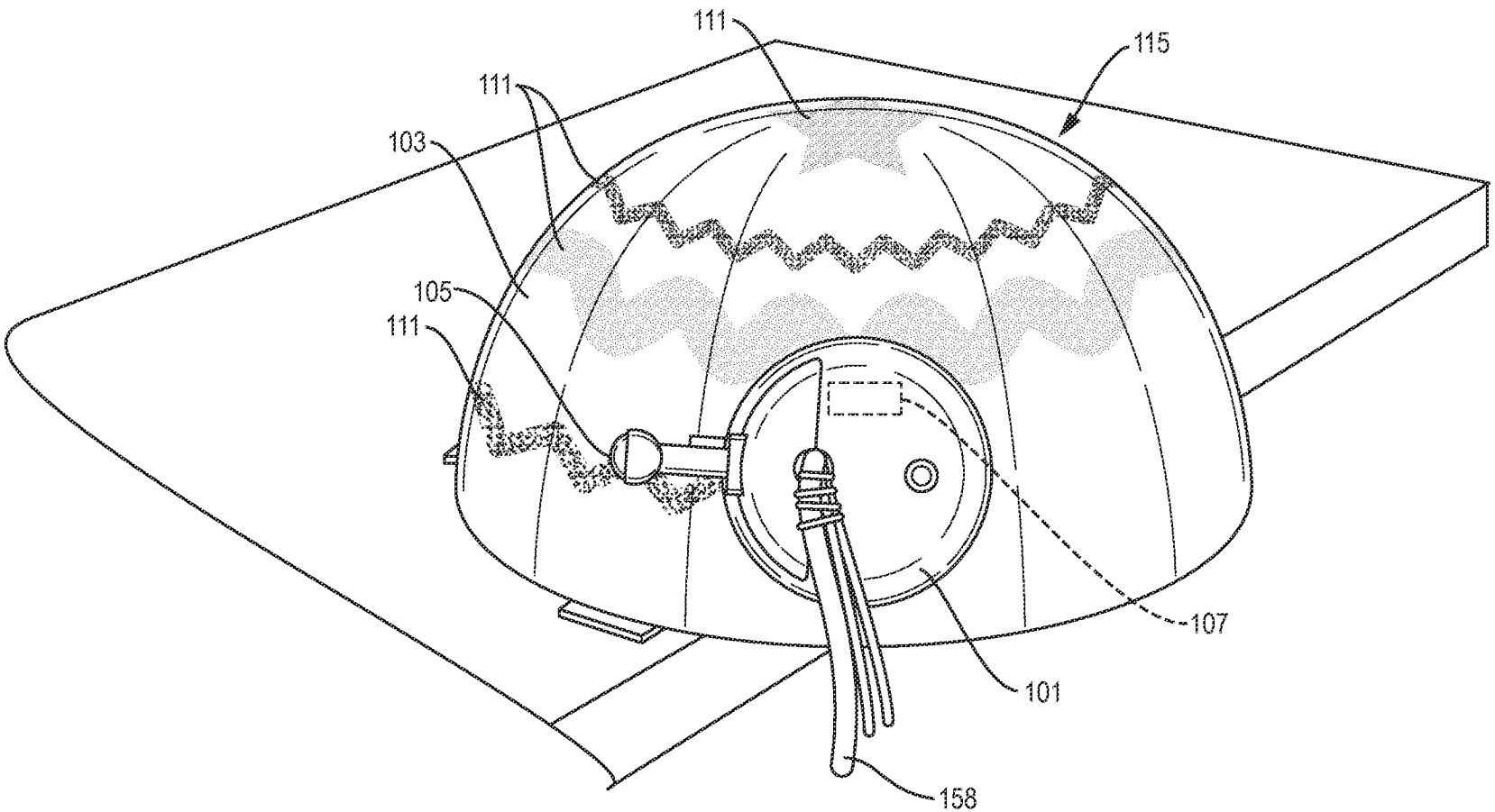
FIG. 1B shows a handheld inkjet printer printing a pattern on the curved surface.

In the example shown in FIGS. 1A and 1B, the surface 103 is a hemispherical surface of an upside-down bowl. However, this invention is not limited to hemispherical surfaces. For example, in some use scenarios, the printer 101 measures and prints on any other type of curved, irregular or planar surface.

FIG. 1B shows a handheld inkjet printer 101 printing a pattern 111 on the curved surface 103 of the workpiece 115, in an illustrative implementation of this invention. One or more sensors detect the 3D position of the printer 101 relative to the surface 103. The printer 101 prints by ejecting ink from nozzles of the print head of the printer. Ink is ejected from a given nozzle at a time when handheld printer 101 is in a position such that ink ejected from the given nozzle is applied to the surface 103 to form part of a target pattern.

The method used to detect the position of the printer 101 relative to the surface 103 of the workpiece 115 may vary. For example, in some cases: (a) the absolute position of the surface 103 has been previously measured by touching a digitizer tip 105 of the printer 101 to surface 103, (b) data indicative of this absolute position has been stored in electronic memory in a computer 109; (c) a position sensor (e.g., a magnetic tracking system (MTS) or optical tracking system) tracks the absolute position and absolute orientation of the handheld printer 101; (c) a computer compares (i) the stored data regarding the absolute position of the workpiece and (ii) the sensor data regarding the current absolute position of printer 101, and (d) from this comparison, the computer determines the position of the printer 101 relative to the surface 103 of the workpiece. In other cases, a differential displacement sensor (e.g., an optical flow sensor) detects a change in position of the printer 101 relative to the surface 103. In other cases, a hybrid approach is used, in which the computer makes a rough estimate of absolute position (e.g., based on sensor readings of an MTS tracking system or optical tracking system) and then fine tunes the estimate based on readings of one or more differential displacement sensors.

Absolute position and absolute orientation mean position and orientation, respectively, in a spatial coordinate system that is fixed relative to the planet on which the handheld printer is located (an "absolute coordinate system"). For example, in the case of a printing system located on Earth with a magnetic tracking system for determining absolute position of handheld printer, the absolute coordinate system may be fixed relative to a point in the magnetic field generator 167 (which is in a fixed location relative to Earth during operation of the printer). For example, in the case of a printing system located on Earth with two external cameras for determining absolute position of the handheld printer, the absolute coordinate system may be fixed with respect to the two external cameras (which are in a fixed position relative to Earth during operation of the printer).

Figure 2A:
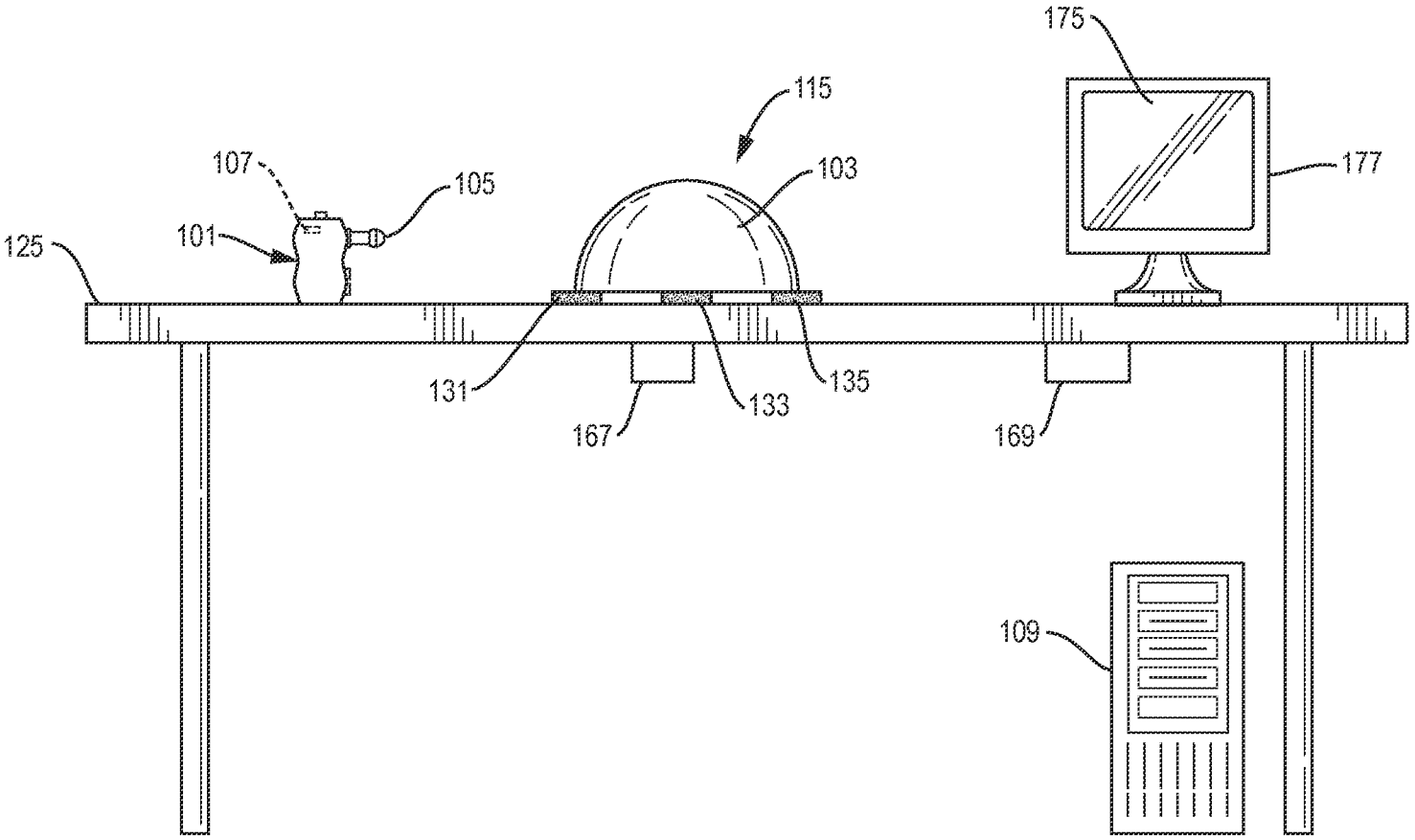
FIG. 2A shows hardware in a printer system.

FIG. 2A shows hardware in a printer system 150, in an illustrative implementation of this invention. A handheld printer 101 is temporarily supported by table 125. The workpiece 115 rests on adhesive layers 131, 133, 135. The adhesive layers 131, 133, 135 are positioned between the workpiece 115 and a table 125. The table 125 supports the adhesive layers. The adhesive layers 131, 133, 135 restrain lateral movement of the workpiece 115. Thus, the adhesive layers 131, 133, 135 prevent lateral movement of the workpiece 115 when the user presses the digitizer tip 105 against the workpiece 115.

During operation of the printer 101, a user picks up the printer 101 from table 125 and holds the printer 101 (e.g., in one hand). While the user holds printer 101, the printer (i) at some times, measures surface 103 of workpiece 115; and (b) at other times, prints a pattern on surface 103.

The printer system 150 includes a magnetic tracking system (MTS) for tracking the position of the handheld printer 101. In the example shown in FIG. 2A, the MTS comprises: (i) a magnetic field generator 167 affixed to table 125, (ii) a magnetic receiver 107 housed in printer 101 and (iii) and a computer (e.g., an integrated circuit, microprocessor or other computer) 169 for controlling the field generator 167 and processing data indicative of measurements taken by the magnetic receiver 107. One or more computers (e.g., 109) control the printer system 150, including controlling a graphical user interface displayed on an electronic display screen 175. In the example shown in FIG. 2A, the display screen 175 is housed in a computer monitor 177.

Display screen 175 displays a graphical user interface (GUI) and other data. For example, in some cases, display screen 175 displays images indicative of one or more of the following: (i) a pattern to be printed on a workpiece; (ii) which portions of the pattern have already been printed or remain to be printed; (iii) a set of patterns from which the user may select, and cause the selected pattern or patterns) to be printed on the workpiece; (iv) a CAD model of a surface of a workpiece; (v) a point cloud of points on a surface of the workpiece, which points were measured by the digitizer tip of the handheld printer; (vi) all or part of a suggested trajectory of the printer, in order to print a pattern or remainder of a pattern; (vii) the position of the printer relative to the workpiece; (viii) the distance of the printer from the workpiece; and (ix) other data regarding the printer or operation or state of the printer, including information regarding ink levels and the need to refill ink.

Figure 2B:
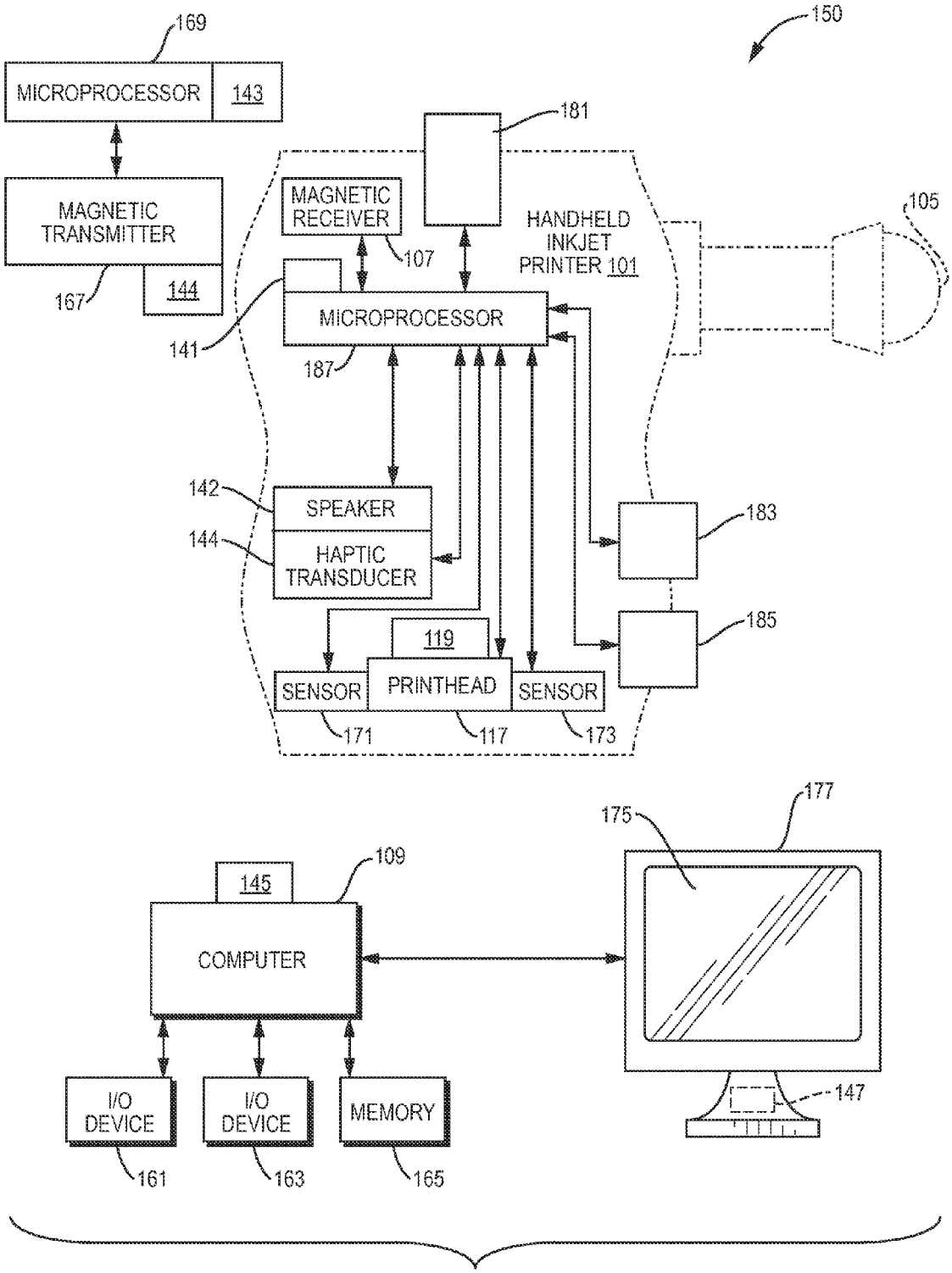
FIG. 2B is a block diagram of a printer system.

FIG. 2B is a block diagram of a printer system 150, in an illustrative implementation of this invention. A handheld inkjet printer 101 houses: (a) a print head 117 and inkjet cartridge 119; (b) magnetic receiver 107 and other sensors (e.g., 171, 173); (c) one or more circuit boards, integrated circuits, microprocessors or other computers 187; (d) a set of I/O devices (e.g., 181, 183, 185); and, optionally (e) wireless communication module 141. For example, in some cases, the other sensors (e.g., 171, 173) comprise optical flow sensors. In some cases, the I/O devices (e.g., 181, 183, 185) comprise one or more moveable components (e.g., buttons, sliders, dials, triggers, joy sticks, or track balls) and electrical or electronic components (e.g., switches, potentiometers, accelerometers, gyroscopes, inertial measurement units and optical flow meters) that detect or measure movement of the moveable components. In some cases, a speaker 142 or haptic transducer 144 provide audio or haptic feedback to a user, such as feedback regarding distance of the handheld printer from a workpiece.

In FIG. 2B, the printer system also includes a magnetic field generator 167 and a microprocessor (or other computer) 169 for controlling the magnetic field generator 167. (The magnetic field generator 167 is sometimes referred to herein as a magnetic transmitter.) The printer system also includes computer 109, additional I/O devices (e.g., 161, 163), an electronic memory device 165, and an electronic display screen 175. In the example shown in FIG. 2B, the display screen 175 is housed in a computer monitor 177. Alternatively, the display screen 175 may be housed in a mobile computing device.

In FIG. 2B, the printer system 150 includes wireless communication modules (e.g., 141, 143, 145, 147) for wireless communication between the modules 141, 143, 145, 147. The wireless communication modules are in turn communicatively connected (e.g., by wired connections) to other components of the printer system 150, such the printer 101, magnetic field generator 167, microprocessor 169, and computer 109. Alternatively, communication between one or more of the components of the printer system 150 is via wired electrical connection (e.g., 158, shown in FIG. 1B).

FIG. 3 shows a user holding a handheld inkjet printer 101, in an illustrative implementation of this invention. The print head 117 is located at the bottom of the printer 101.

Figure 4:
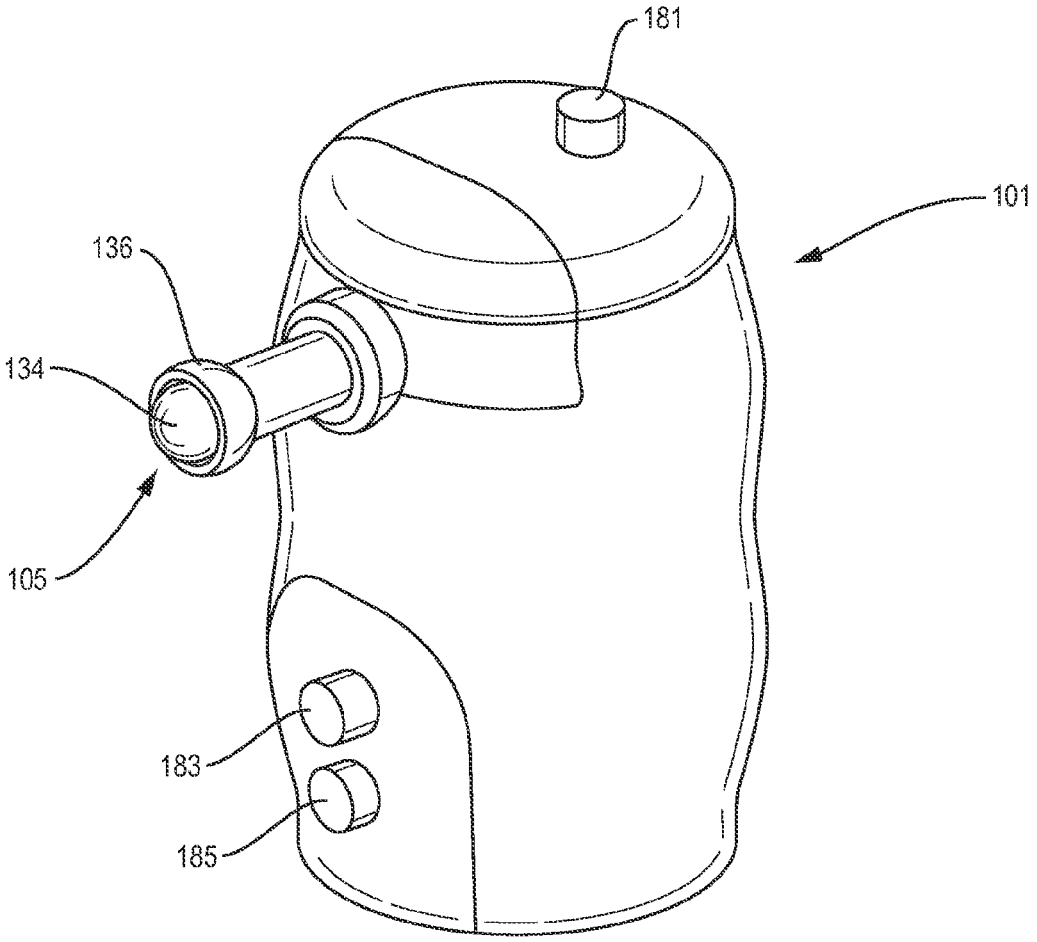
FIG. 4 is another view of the printer shown in FIG. 3.

FIG. 4 shows another view of printer 101, in an illustrative implementation of this invention. A portion of three I/O devices 181, 183, 185 extend outwards past the housing of printer 101. In the example shown in FIG. 4, the I/O devices comprise buttons and circuity to detect motion or position of the buttons. For example, in some cases, the circuity includes a Schmitt trigger or other circuitry to mitigate mechanical switch bounce.

In some cases, current spikes associated with firing inkjet nozzles in the print head 117 interfere with the magnetic receiver 107. In order to reduce this interference, it is helpful to increase the distance between the magnetic receiver 107 and print head 117.

Figure 5:
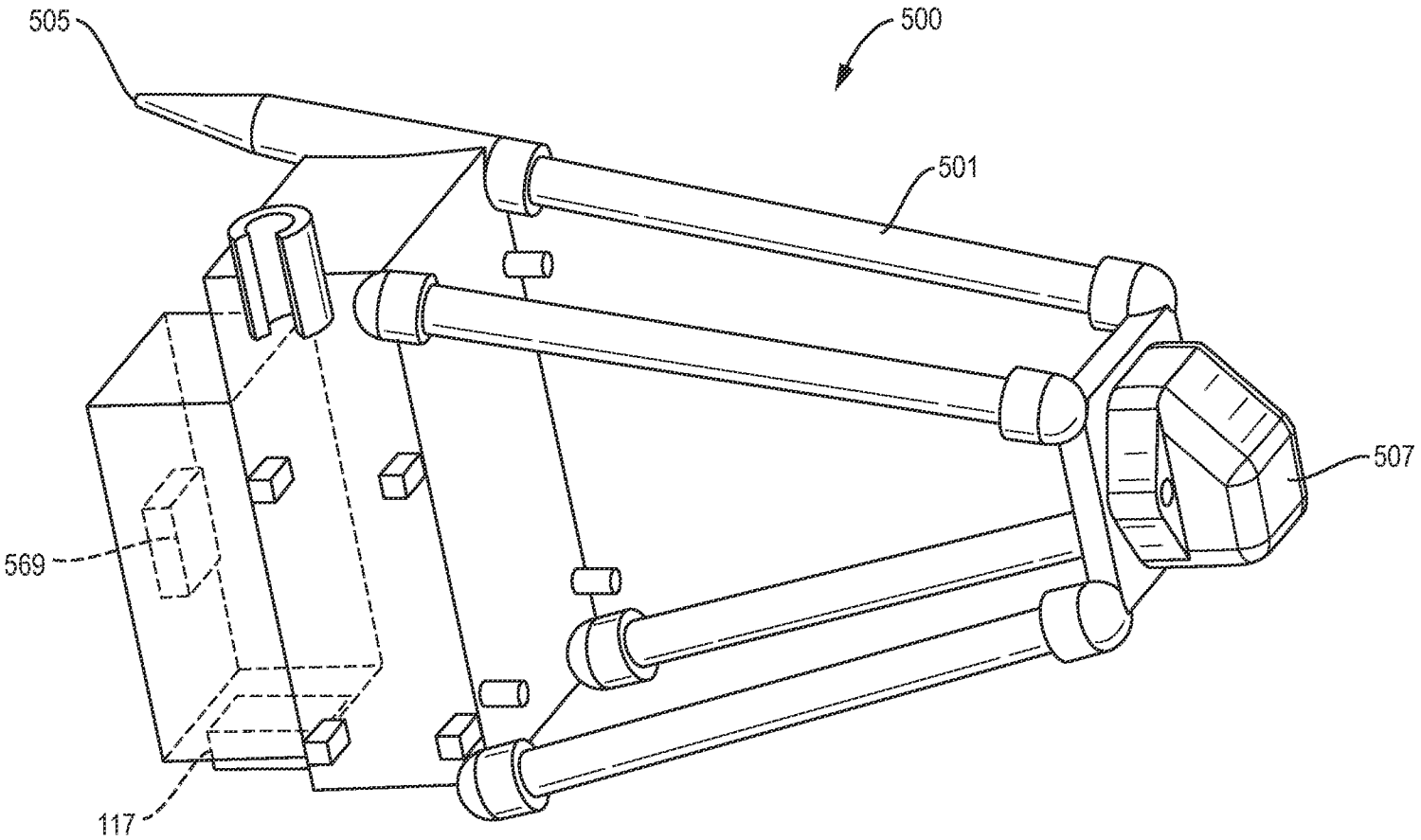
FIG. 5 shows a second example of a handheld inkjet printer

FIG. 5 shows a second example of a handheld inkjet printer 500, in an illustrative implementation of this invention. In FIG. 5, a magnetic receiver 507 is mounted on a structural frame 501 that positions the magnetic receiver 507 at a distance from the print head 117 and a print head control circuit board 569. This tends to reduce interference with the magnetic receiver 107 that would otherwise be caused by current spikes in the print head 117. In the example shown in FIG. 5, the end of a protuberance 505 (also called a "digitizer tip") is pressed against a surface 103 of a workpiece 115 while the printer 500 measures the 3D position of points on the surface 103.

In the example shown in FIG. 5, the digitizer tip 505 comprises a conically shaped, solid piece that is a single, integral part.

In contrast, in the example shown in FIG. 4: (a) the digitizer tip 105 includes a ball 134 that rotates as the tip 105 is moved along the surface of a workpiece; (b) the digitizer tip 105 also includes a solid part 136 that partially surrounds the ball 134 and limits non-rotational movement of the ball 134 relative to the solid part 136; and (c) thus, a user may hold and move the handheld printer such that its digitizer tip rolls across a surface while the digitizer tip is pressed against the surface.

Figure 6:
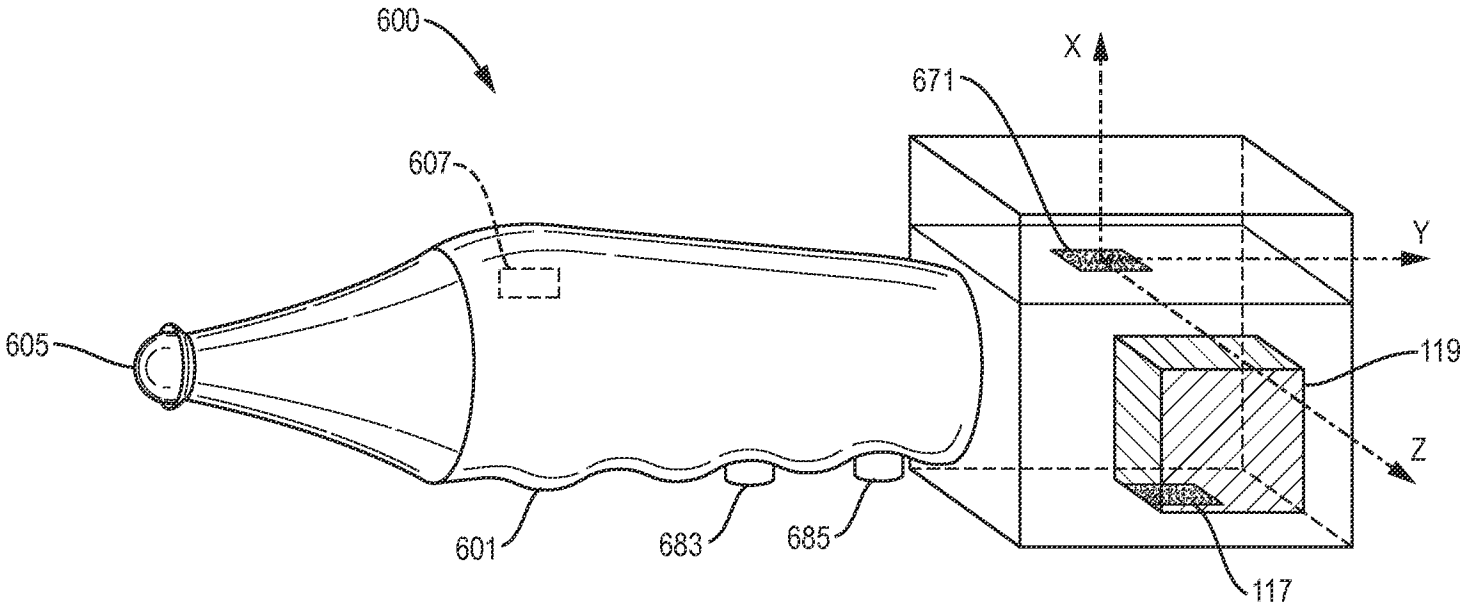
FIG. 6 shows a third example of a handheld inkjet printer.

FIG. 6 shows a third example of a handheld inkjet printer 600, in an illustrative implementation of this invention. In FIG. 6, a portion of the housing of the printer 600 is in the shape of a handle 601, with ridges and indentations to facilitate being gripped by a user's hand. A protuberance extends from one end of the handle 601. A digitizer tip 605 is at the end of the protuberance. A magnetic receiver 607 that is part of a magnetic tracking system is housed in the handle 601. The printer includes a print head 117 and inkjet cartridge 119. The print head 117 includes inkjet nozzles. The printer also includes a sensor module 671 that comprises a three-axis accelerometer, three-axis gyroscope, and an inertial measurement unit ("IMU"). The sensor module measures change in position, as opposed to absolute position, of the handheld printer 600 relative to the surface of the workpiece. Differential displacement sensors (such as the accelerometer, gyroscope and IMU in sensor module 671) may be used in conjunction with an absolute position sensor (such as an MTS or optical tracker), as discussed in more detail with respect to FIG. 9. In some cases, sensor module 671 comprises a MEMS (microelectromechnical system).

In illustrative implementations, a handheld inkjet printer includes I/O devices for accepting user input regarding a "manual override" instruction. For example, in FIG. 6, a user presses a button (e.g., 683 or 685). As the button is pressed, a control signal is sent. A computer takes this control signal as an input (e.g., as an interrupt) that triggers a "manual override" mode of operation.

In some cases, during "manual override" mode, the printer creates an effect similar to an airbrush. Specifically, the nozzle-control algorithm causes all the nozzles of the print head to fire, so that the printer prints a swath of ink as wide as the print head.

In other cases, in the "manual override" mode, the printer reapplies ink over an area in order to make the pattern darker in the area. Specifically: (a) a computer performs a nozzle-control algorithm that ignores whether the target area has already been printed on or not; (b) nozzles that would apply ink over areas that are not targeted to receive ink are not fired, and (c) nozzles re-apply ink over areas that have already received ink once.

In yet other cases, in the "manual override" mode, the nozzle-control algorithm stops all nozzles from firing even if some of them would have otherwise fired. This allows the user to create patterns by not applying ink on certain regions.

In still other cases, in the "manual override" mode, a computer: (a) switches from a first pattern used to determine nozzle firing to a second pattern set by the user; and (b) thus allows the user to selectively mix two different patterns in the same print.

In some implementations, the "manual override" mode occurs during the entire time that the trigger button is depressed, and ends when the button is no longer depressed. Alternatively, the beginning and end of the "manual override" mode may be controlled by one or more simultaneous or sequential inputs from the user via one or more I/O devices. For example, in some cases, the beginning and end of "manual override" mode each occur when a user presses and then releases a button (e.g., 683, 685).

Figure 7:
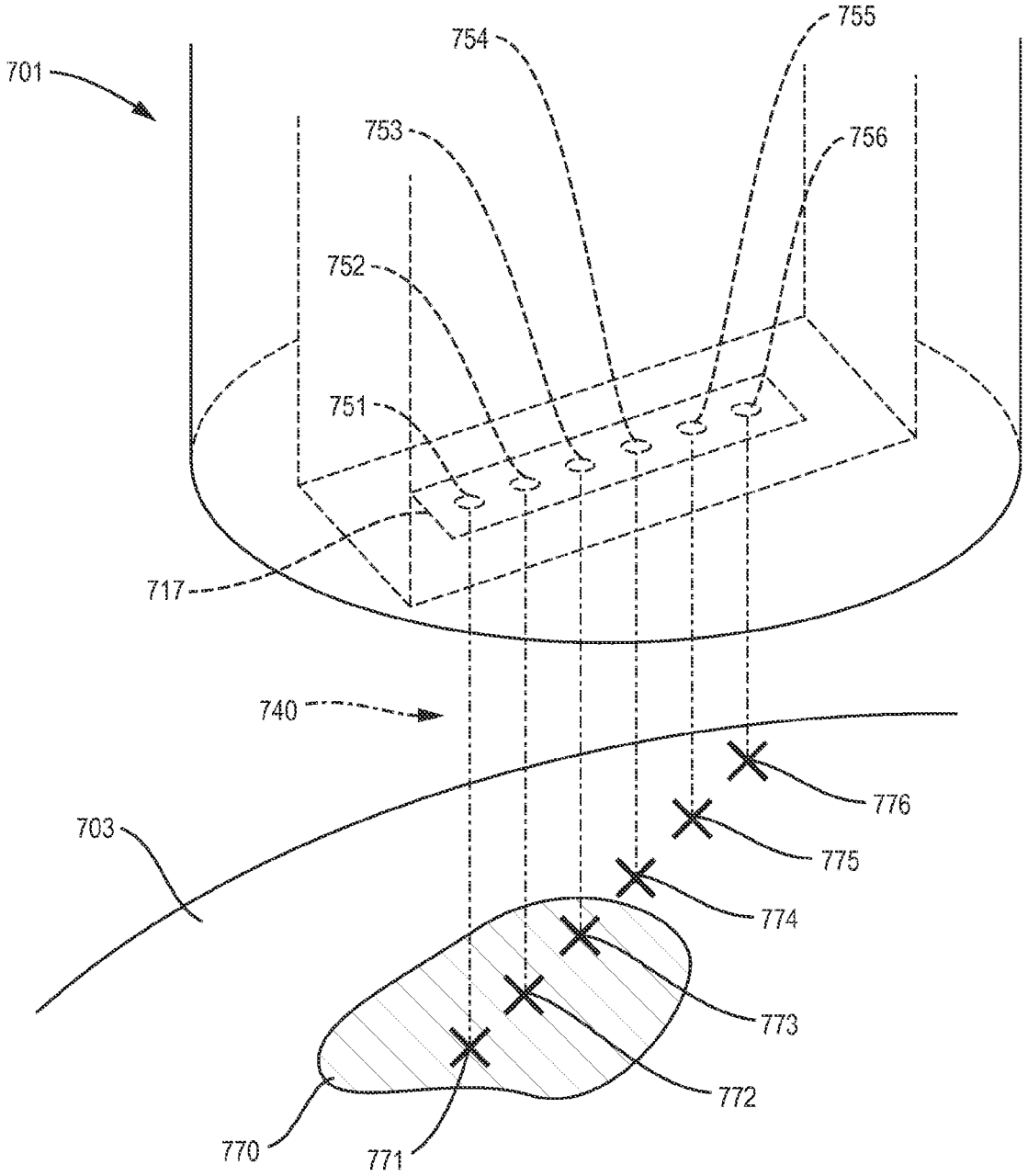
FIG. 7 shows trajectories in which ink would travel if ejected from nozzles of a print head.

FIG. 7 shows trajectories 740 in which ink would travel, if ejected from nozzles of a print head, in an illustrative implementation of this invention. In FIG. 7, a print head 717 includes multiple nozzles. In many cases, the number of nozzles in the print head 717 is more than 100 nozzles, or more than 200 nozzles, or more than 300 nozzles. For ease of illustration, however, only a subset of the nozzles (751, 752, 753, 754, 755, 756) in print head 717 are shown in FIG. 7. The print head 717 is housed in a handheld inkjet printer 701.

In the example shown in FIG. 7, a computer model specifies that region 770 of surface 703 is an area to which ink is to be applied (a "target area"). In FIG. 7, a computer (e.g., 109 or 169): (a) processes measurements from a tracking system; (b) calculates that nozzles 751, 752 and 753 are pointed at subregions 771, 772 and 773, respectively, of target area 770 and are within a threshold distance of these subregions; (c) calculates that ink has not yet been applied to subregions 771, 772 and 773; and (d) sends control signals to a print head control board, which in turn controls the print head 717 such that nozzles 751, 752, 753 eject ink and this ink is deposited on subregions 771, 772 and 773, respectively. The computer also determines that nozzles 754, 755 and 756 are pointed at subregions 774, 775, and 776, respectively; and that nozzles 754, 755 and 756 should not be fired at this time because subregions 774, 775 and 776 are not located in a target region.

In some implementations, the handheld inkjet printer is a color printer and the different nozzles eject different colors of ink, in order to print a multi-colored pattern. For example, in some use scenarios, different large-scale regions of the pattern are different colors (e.g. a red region and a green region). In some cases, small inkdrops of different colors (e.g., cyan, magenta, and yellow) are printed in a dithered pattern, or printed with half-tone or overlaid dot patterns that appear to a human viewer to include a wide palette of colors.

In illustrative implementations, when the printer is not operating in "manual override" mode, a nozzle ejects ink when: (a) the nozzle is pointed toward a subregion of a target area, (b) ink has not yet been applied to the subregion; and (c) the distance between the nozzle is and the subregion is within a specified threshold. For example, in some prototypes of this invention, the threshold is 20 mm. The computer models the ink as traveling in a straight line from the nozzle to the target area.

In addition, in some implementations (e.g., with a thermal inkjet print head), small quantities of ink exit the nozzle at some times for cleaning purposes (e.g., to soften buildup on the print head before the buildup is wiped away).

Figure 8:
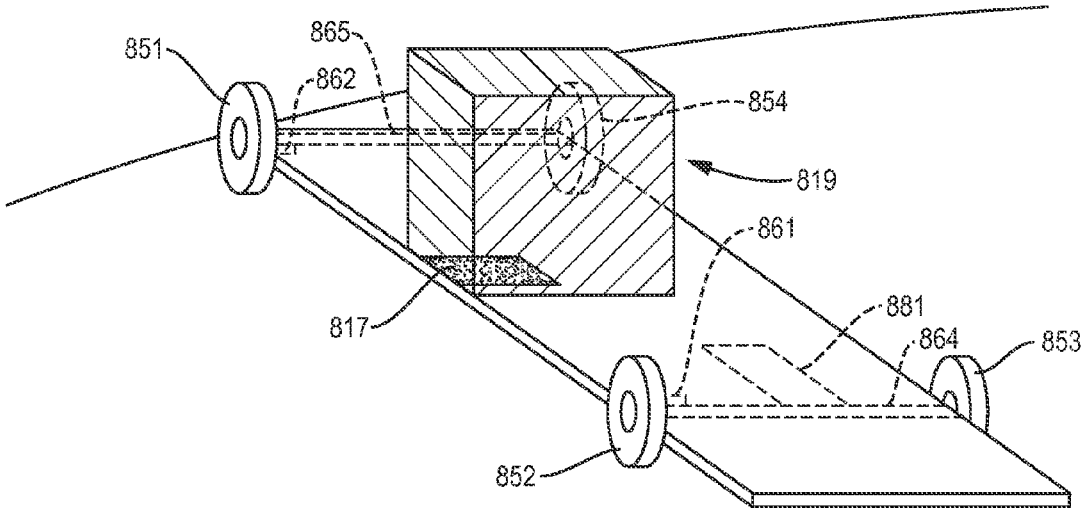
FIG. 8 shows a portion of a handheld inkjet printer with wheels.

FIG. 8 shows a portion of a handheld inkjet printer with wheels, in an illustrative implementation of this invention. In FIG. 8, the so-called "print face" of the printer is facing down. The print face is the side of the printer from which ink is ejected by the nozzles. Wheels 851, 852, 853, 854 are mounted to the printer. As the printer is wheeled across a surface of a workpiece, the wheels tend to maintain a constant distance between the print head 817 and the surface, at least on a planar surface or (in some cases) in a region of a curved surface. In some cases, a computer (e.g., 109) controls one or more steering mechanisms (e.g. 881) that each steer one or more wheels. The steering provides haptic feedback to a user about the direction in which the printer should be moved. The one or more steering mechanisms (e.g., 881) each include an actuator and components (e.g., linkage or cables) for transmitting force to the wheel(s) being steered. An inkjet cartridge 819 is adjacent to the print head 817.

In the example shown in FIG. 8, the handheld inkjet printer includes one or more rotary encoders (e.g., 861, 862) for measuring rotation of one or more of the wheels. In some cases, a rotatory encoder measures rotation of a wheel by measuring rotation of an axle or shaft (e.g. 864, 865) attached to the wheel. For example, in some cases, a rotary encoder measures the rotation of a shaft or axle by measuring angular position or angular motion of the axle or shaft. A computer transforms this rotary encoder data (regarding angular position or angular motion of an axle or shaft) into relative displacement data (e.g., into data regarding position or motion of the handheld printer relative to a curved surface of workpiece 815). In some cases, the computer also transforms this rotary encoder data into data regarding orientation of the handheld printer, by performing a calculation that takes as inputs (i) relative displacement, (ii) absolute position data regarding a starting point for the displacement, and (iii) data regarding the shape of a 3D curved surface that the wheels are pressed against. A variety of different types of rotary encoders may be employed. For example, in some cases, the rotary encoders (e.g., 861, 862) comprise either an optical encoder, an "on axis" magnetic encoder, an "off axis" magnetic encoder, or a conductive encoder (e.g., with contact brushes that brush against conductive tracks disposed along a circumference). In some cases, the rotary encoders comprise so-called "absolute" encoders that store position data when power is turned off. In some cases, the rotary encoders comprise so-called "incremental" encoders that do not store position data when power is turned off.

Figure 9:
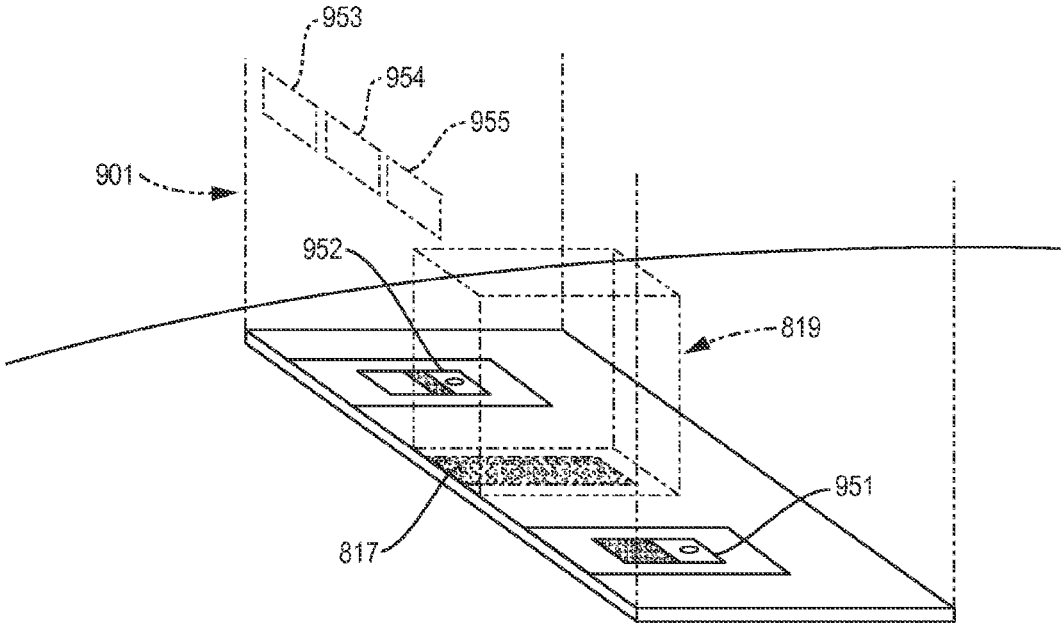
FIG. 9 shows a portion of a handheld inkjet printer with differential displacement sensors.

FIG. 9 shows a portion of a handheld inkjet printer with differential displacement sensors, in an illustrative implementation of this invention. In FIG. 9, a handheld printer 901 includes the following differential displacement sensors: optical flow meters 951, 952, a three axis accelerometer 953, a gyroscope 954, and an inertial measurement unit 955. These differential displacement sensors measure a change in position (differential displacement) of the printer 901 relative to a workpiece, as opposed to an absolute position of the printer 901. In some cases (e.g., in which an optical flow sensor takes measurements), the differential displacement that is measured is a displacement along a planar or curved surface of the workpiece, such as a displacement in two spatial coordinates of the surface. In some other cases (e.g., in some cases in which an accelerometer, gyroscope or IMU is used), the differential displacement that is measured is 3D displacement in a Cartesian coordinate system.

If used alone without a means of detecting absolute position, the differential displacement sensors would be subject to drift.

Advantageously, however, the differential displacement sensors (e.g., 951, 952, 943, 954, 955) may be used in conjunction with another sensor system (e.g. a magnetic tracking system or optical tracking system) that detects absolute position. In many cases, a hybrid system (with both differential displacement and absolute position sensors) achieves higher accuracy with less expensive hardware than either approach (differential displacement or absolute position) alone.

For example, using differential displacement sensors in conjunction with magnetic sensing is particularly useful in embodiments where a high-frame rate (e.g., 1600 Hz) inkjet cartridge is used. A tracking system that estimates the absolute position of the device at such a high rate would be expensive.

In contrast, in some cases, a hybrid tracking system: (a) is implemented with a Kalman filter; (b) calculates a low-frequency (e.g., 100 Hz) absolute position estimate (e.g., from an MTS or optical tracker); (c) measures differential displacement (e.g., with an optical flow sensor); and (d) uses the differential displacement sensor data to interpolate between absolute position estimates.

In some implementations of this invention, a computer performs a Kalman filter algorithm that utilizes data from both differential displacement sensors and an absolute position sensor. For example, in some cases: A printer system includes both (i) sensors (e.g., a magnetic tracking system) that measure absolute position of a handheld printer and (ii) sensors (e.g., an optical flow meter, accelerometer, gyroscope and IMU) that measure a change in position of the handheld printer relative to the work piece. A computer (e.g., 109) in the printer system performs a Kalman filter algorithm that takes these measurements as inputs and that iteratively estimates position of the handheld printer. In this example, the Kalman filter algorithm calculates state variables (e.g., three spatial coordinates X, Y, Z and three Euler angles) indicative of the position of the handheld printer. In each iteration, out of a set of iterations in the Kalman filter algorithm, a computer performs a propagation step and an update step. In the propagation step (also known as a prediction step), the computer calculates an "a priori" estimate of the current position of the handheld printer based on the state estimate from the last iteration of the algorithm and based on data that is gathered by the one or more differential displacement sensors regarding change in position of the handheld printer. In the update step, the computer calculates a so-called "a posteriori" estimate of the current position of the handheld printer, based on a new measurement of the absolute position of the handheld printer and on the "a priori" estimate.

Figure 10:
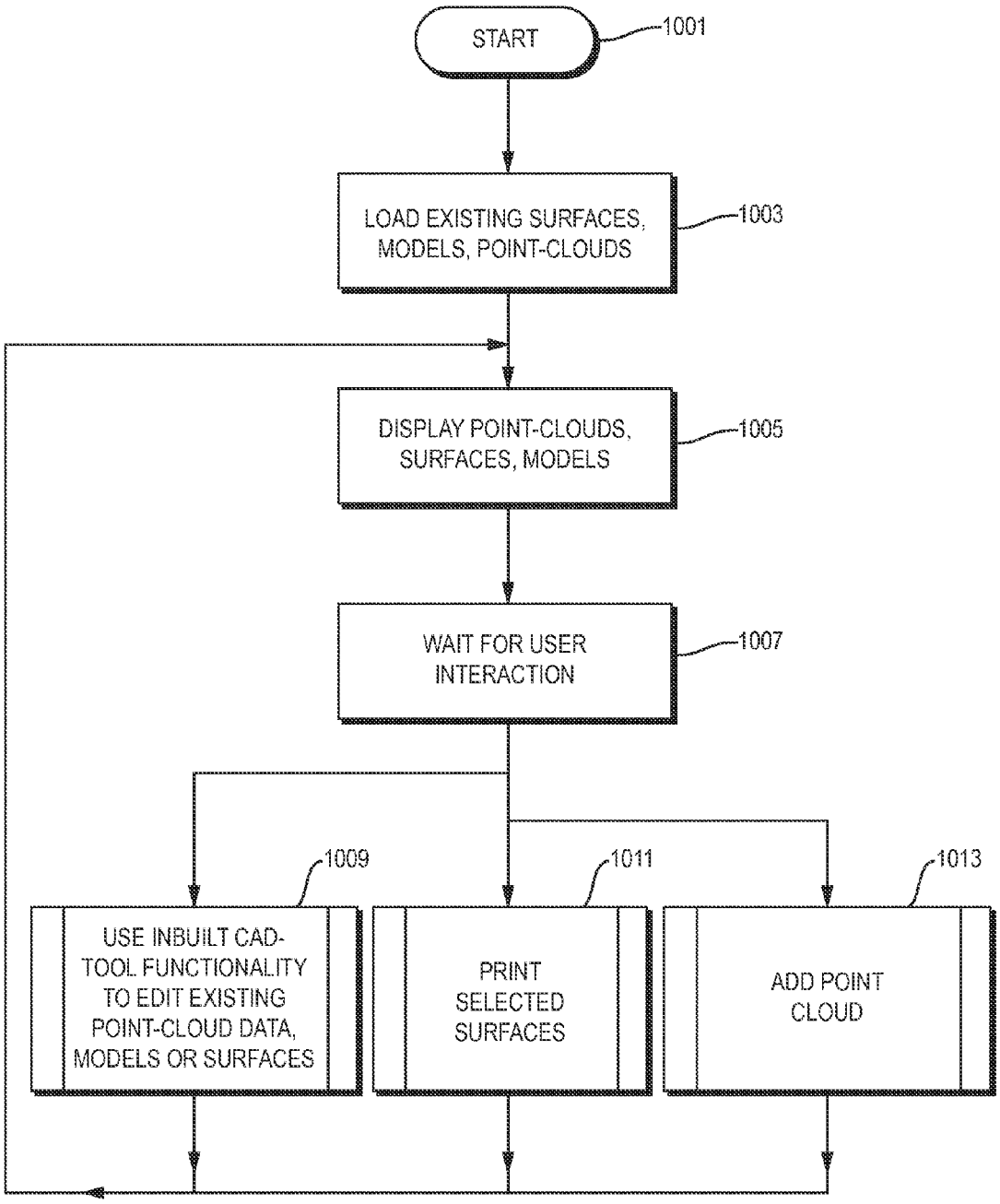
FIG. 10 shows steps in a method for computer modeling and handheld inkjet printing.

FIG. 10 shows steps in a method for computer modeling and handheld inkjet printing, in an illustrative implementation of this invention. The method shown in FIG. 10 includes at least the following steps: Start (Step 1001). Load existing point-clouds, NURBS (non-uniform rational B-spline) surfaces, and other CAD (computer-assisted design) models. In some cases, the NURBS surfaces, CAD models or point-clouds represent a workpiece or points on a surface of the workpiece (Step 1003). Display point-clouds, surfaces and models. In some cases, an electronic display screen displays an interactive GUI. For example, in some cases, the display screen is housed in mobile computing device or a computer monitor (Step 1005). Wait for user interaction (Step 1007). Use inbuilt CAD-tool functionality to edit existing point-cloud data, models or surfaces (Step 1009). Print onto selected surfaces (Step 1011). Add point-cloud (Step 1015).

Figure 11:
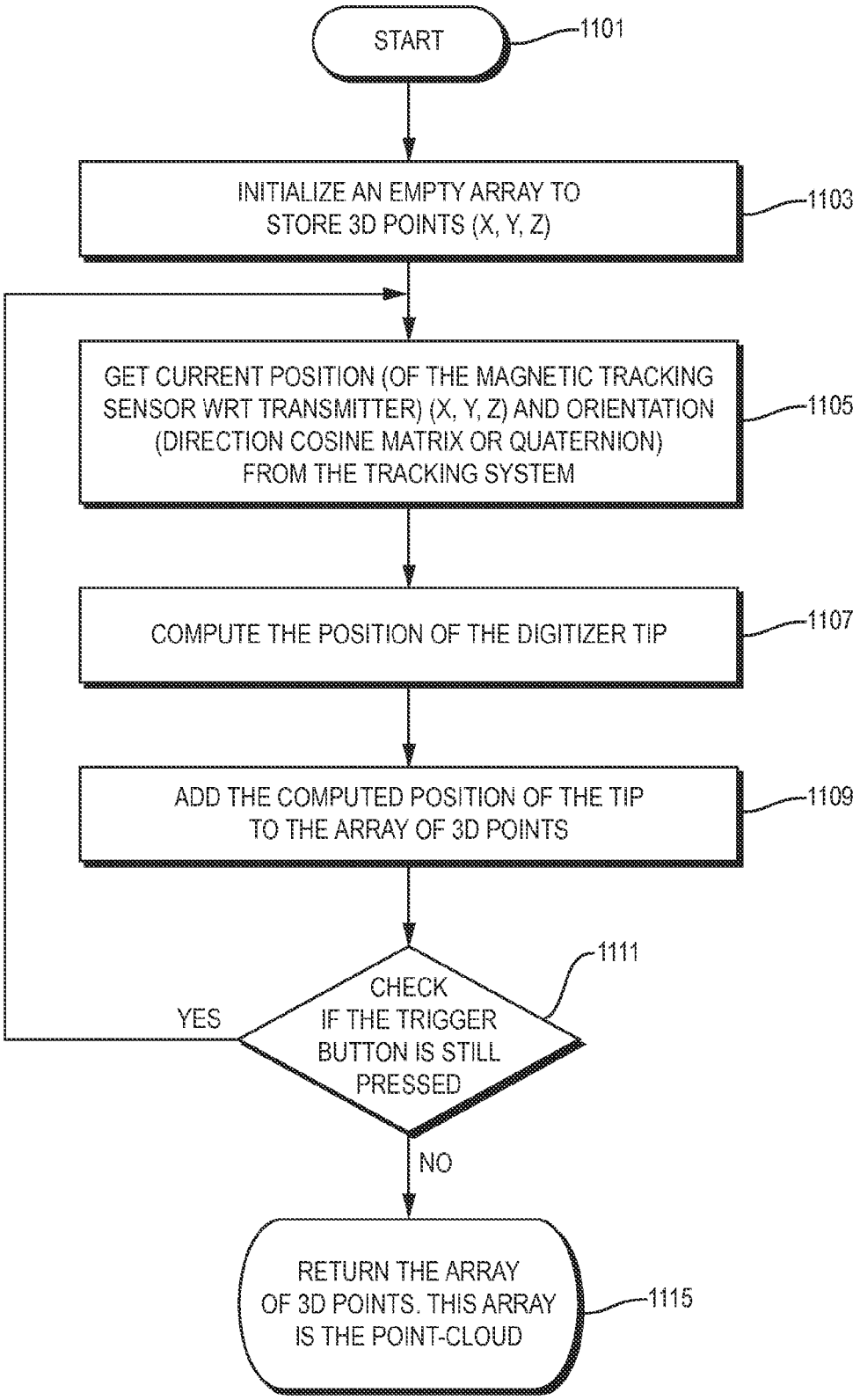
FIG. 11 shows steps in a method for computing a digital point-cloud that represents a shape of an exterior surface of a workpiece.

FIG. 11 shows steps in a method for computing a digital point-cloud that represents points of an exterior surface of a workpiece, in an illustrative implementation of this invention. The method shown in FIG. 11 includes the following steps: Start (Step 1101). Initialize an empty array to store 3D Points X, Y, Z (Step 1103). Get current position and orientation of the handheld printer from the tracking system. In some cases, orientation of the handheld printer is denoted with quaternions or a direction cosine matrix (Step 1105). Compute position of the digitizer tip (Step 1107). Add the computed position of the digitizer tip to the array of 3D points (Step 1109). Check if the trigger button is still pressed (Step 1111). If yes, go to step 1105; if no, go to step 1115. Return (e.g., output to user in readable format) the array of 3D points (Step 1115).

Figure 12A:
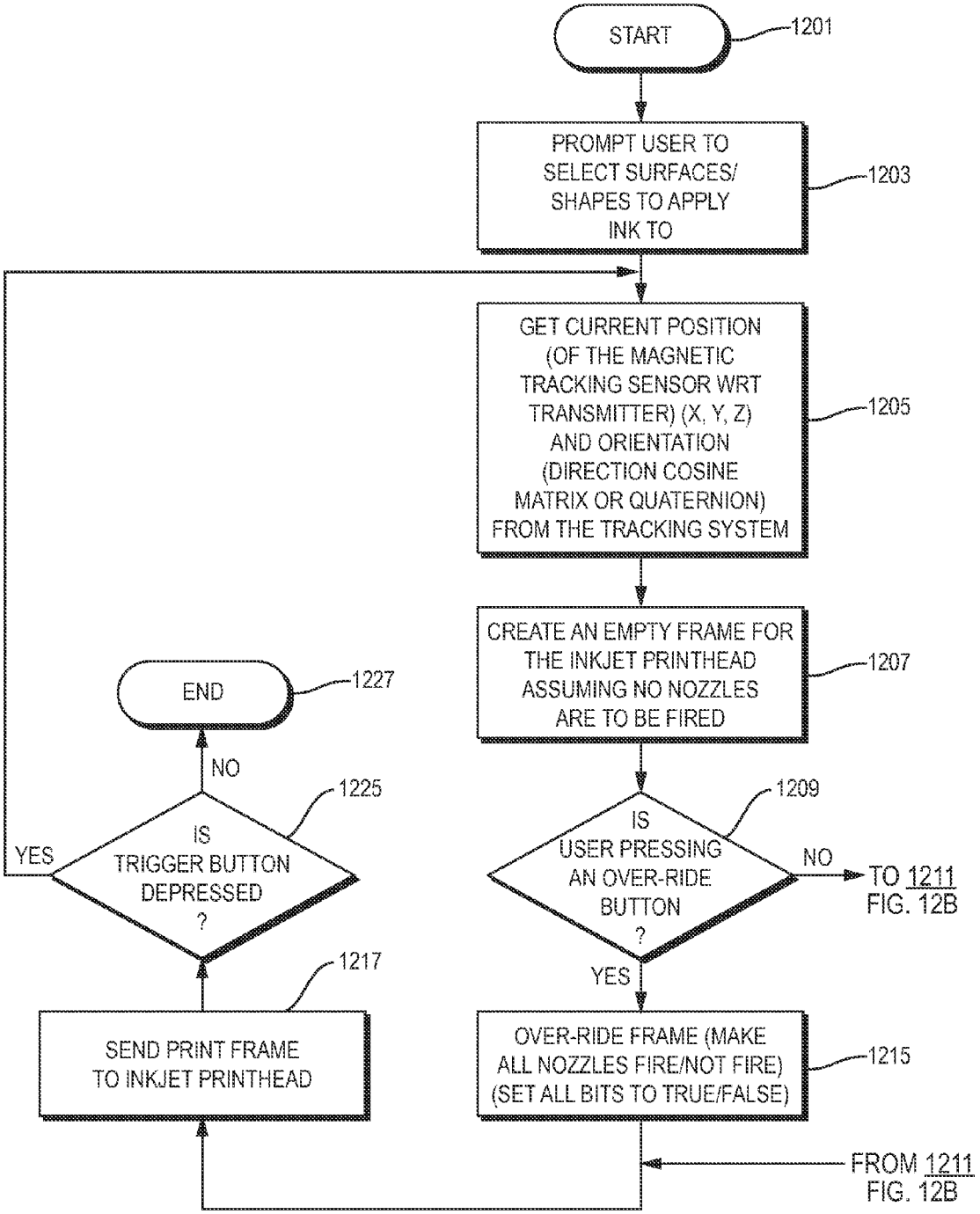
FIG. 12A and FIG. 12B show steps in a method for controlling a print head.
Figure 12B:
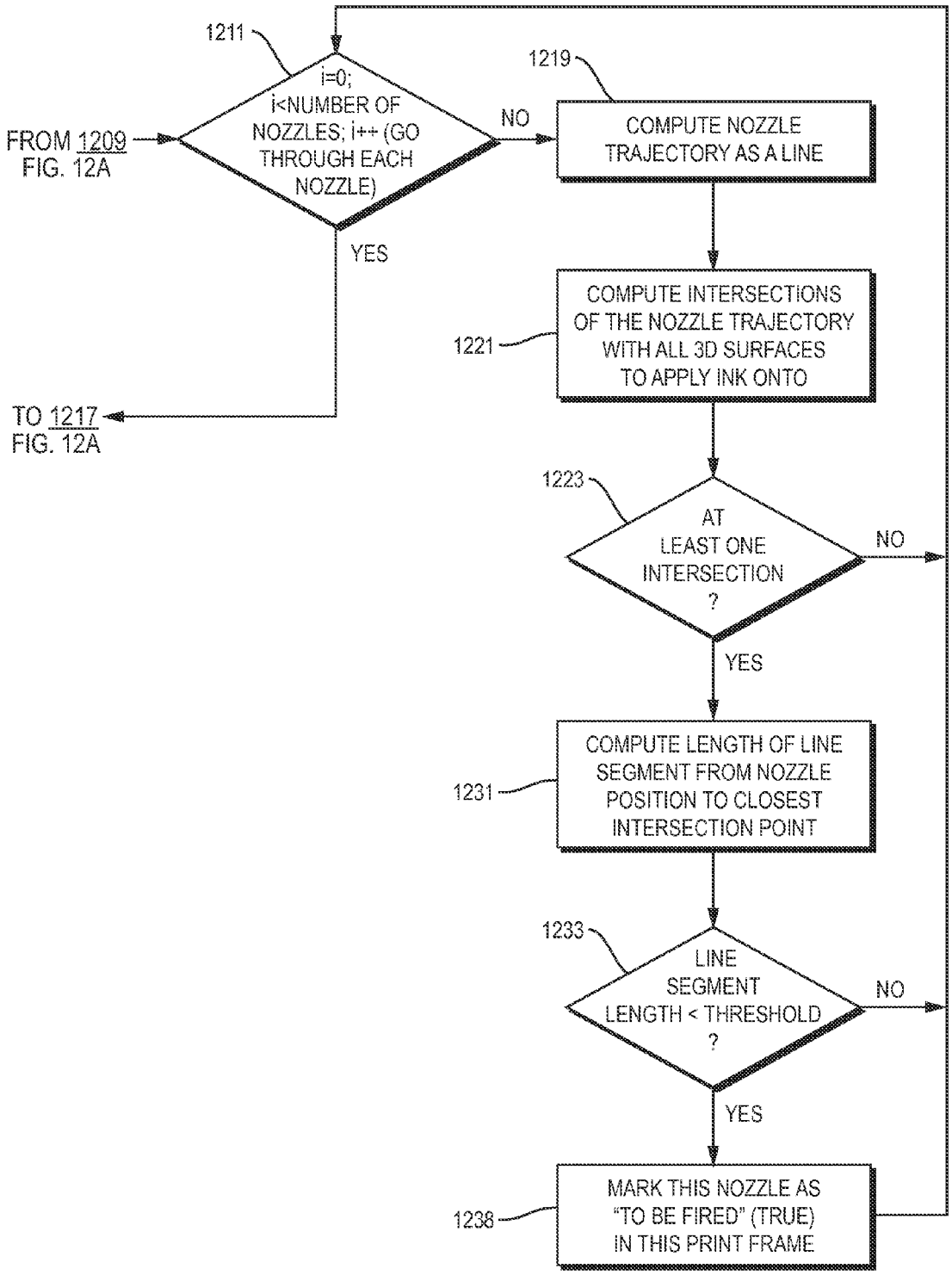

FIGS. 12A and 12B shows steps in a method for controlling a print head, in an illustrative implementation of this invention. Start (Step 1201). Prompt user to select surfaces/shapes to apply ink to (Step 1203). Get current position and orientation of the handheld printer from the tracking system. In some cases, orientation of the handheld printer is represented by quaternions or a direction cosine matrix (Step 1205). Create an empty frame for the inkjet print head assuming no nozzles are to be fired (Step 1207). Determine if user is pressing an over-ride button (Step 1209). If the user is pressing an over-ride button, then over-ride frame to make all nozzles fire or to make all nozzles not fire (e.g., set all bits to true/false) (Step 1215), and then go to step 1217. If the user is pressing an over-ride button (Step 1209), go to step 1211. Go through each nozzle (i=0, i<number of nozzles, i++) (Step 1211). If less than all of the nozzles have been gone through, compute the trajectory of a nozzle as a ray starting from the position of the nozzle (Step 1219). Compute geometric intersections of the ray with all surfaces selected by the user to print (Step 1221). Determine if there is at least one geometric intersection (Step 1223). If there is not at least one intersection, then go to Step 1211. If there is at least one least one intersection, then compute the distance of the nozzle to the closest intersection point (Step 1231). The closest intersection point is the point for which the distance is minimum. If the distance is less than a threshold (Step 1233), then mark the nozzle as "to be fired" (true) (Step 1238), and go to step 1211. If the distance is greater than the threshold (Step 1233), go to step 1211. After going through all the nozzles (Step 1211), send print frame to inkjet print head (Step 1217). Determine whether trigger button is depressed (Step 1225). If yes, go to Step 1205; if no, go to Step 1227. End (Step 1227).

Figure 13A:
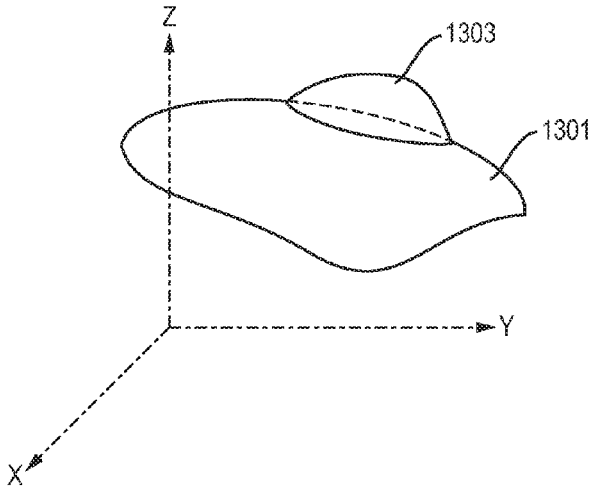
FIG. 13A shows a non-limiting example of a 3D curved surface.
Figure 13B:
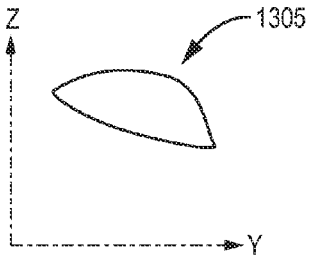
FIGS. 13B, 13C and 13D show a projection of a region of the curved surface onto the yz, xz and xy planes, respectively.
Figure 13C:
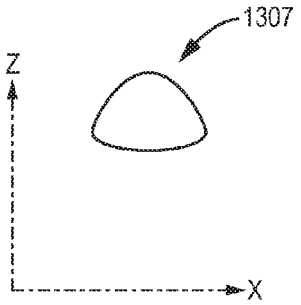
Figure 13D:
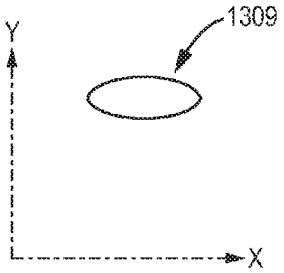

FIG. 13A shows a non-limiting example of a 3D curved surface 1301. The 3D curved surface 1301 includes region 1303. FIG. 13B shows a projection 1305 of region 1303 onto the yz plane. FIG. 13C shows a projection 1307 of region 1303 onto the xz plane. FIG. 13D shows a projection 1309 of region 1303 onto the xy plane. In the example shown in FIGS. 13B, 13C and 13D, the projections 1305, 1307 and 1309 are curved.

Prototype

The following eight paragraphs describe a prototype of this invention. The prototype is a non-limiting example of this invention.

In this prototype, the hardware components include: (a) a handset; and (b) a Polhemus™ FASTRAK™ Magnetic Motion Tracking system (MTS) to estimate the 3D position and 3D orientation of the handset. The MTS comprises an AC 6D magnetic tracking system.

In this prototype, the handset comprises a handheld printer. The housing of the handset comprises plastic. The handset includes an HP C6062 inkjet print head to print on the workpiece. The HP C6602 inkjet print head comprises 12 nozzles arranged at a resolution of 96 dpi. The print head exposes 13 terminals: the first 12 terminals are for the 12 nozzles respectively, and the last terminal for ground. To shoot an inkjet drop from a nozzle, a voltage of ~16 v is pulsed once for a duration of about ~20 milliseconds.

An ArduinoNano board drives the HP C6602 control board based on print data received from the computer over a Serial over USB connection.

To allow the user to use the handset to import features of the object into the computer, the handset includes a pointed tip, which may be used as a 3D digitizer to input pointclouds into the CAD software. Further, the handset is mounted with two buttons for selecting a mode of operation: digitizing versus printing. The buttons may also be used to activate special software functions.

In this prototype, the magnetic tracking system (MTS) includes a transmitter (also called a magnetic field generator) and a receiver. The MTS detects the position and orientation of the receiver with respect to the transmitter. The receiver is rigidly mounted to and housed in the handheld printer. The magnetic field generator is rigidly mounted to the work-table, below the table surface. The MTS includes three orthogonal coils both in the receiver and the transmitter. The MTS measurements are based, at least in part, on the magnetic field vector for the magnetic field generated by each coil as recorded at the receiver. To avoid ambiguity in magnetic sensor readings, the magnetic transmitter is rigidly affixed underneath the table, and the user is assumed to only be working above the table. Alternatively, in some cases, multiple magnetic sensors are used to increase the size of the working area or to increase accuracy.

In this prototype, a computer takes as input the orientation and position measured by the MTS and performs an algorithm to compute the position and orientation of the digitizer tip and the inkjet nozzles on the handset. The algorithm includes computing 3D translations in the frame of reference of the handset.

In this prototype, a computer executes software programs, including a plugin written for Rhinoceros™ 5.0 3D modeling software).

In this prototype, a computer translates the position and orientation state of the handheld printer given by the tracking system, into the position of the tip in the reference frame of the MTS transmitter. In some cases, the MTS outputs the orientation data as a quaternion.

Two frames of reference are used for computations in this prototype: the ground frame of reference is fixed on the transmitter of the tracking system, while a second reference frame is fixed on the receiver. As the receiver is mounted rigidly on the handset chassis, this reference frame may be used to describe the positions of the digitizer tip and the inkjet nozzles on the handset. The CAD model of the workpiece, however, uses the ground reference frame, because the workpiece (object being printed on) is stationary and assumed to be fixed with respect to the MTS transmitter.

In this prototype, the print mode allows a user to select a shape in a CAD model. The user moves the handset back and forth on the workpiece (similar to the motion made when painting with a paint roller) to raster the desired area with the selected shape. During print mode, a computer calculates the nozzle trajectories for each tracking frame, and calculates whether a nozzle trajectory intersects with the desired shape to be printed on the object. The nozzles that are within 20 mm from the point of intersection are issued commands to fire. The trajectory of an ink droplet is modeled as a straight line originating from the nozzle. This computation is done in realtime. To facilitate real-time computation, shapes are represented as wire-mesh, which allows for much faster computation of nozzle trajectories and surfaces; as compared to Rhino's native representation (NURBS).

In this prototype, the digitizer mode lets the user create a pointcloud scan of the workpiece. In digitizer mode, a computer introduces a new 3D point corresponding to the position of the digitizer tip in the active document for each tracking frame.

In this prototype, an illustrative workflow is: (a) The user uses the digitizer tip to create a point-cloud for the features of interest of the workpiece. (b) A computer performs operations on the point-cloud. (c) The user transfers the operations back to the workpiece.

In this prototype, a user may move design problems that are best solved in CAD to the computer, and then take the results back onto the workpiece. Thus, a user may include CAD in the fabrication workflow more seamlessly.

This invention is not limited to the above-described prototype. Instead, this invention may be implemented in many different ways.

Operation, Generally

In illustrative implementations, the handheld printer operates in at least two different modes: digitizer mode and print mode.

The digitizer mode lets the user scan pointcloud data using the digitizer tip of the handheld printer. In some cases, the user activates the digitizer tip mode by pressing a digitizer button.

In some cases, the pointcloud data is generated as follows: A magnetic tracking system (MTS) tracks the 3D position and 3D orientation of the handheld printer. Specifically: An MTS transmitter is rigidly mounted underneath a table and a MTS receiver is rigidly mounted in the handheld printer. The workpiece (object being printed on) is rigidly attached to the top of the table. The MTS measures the position and orientation state of the MTS receiver, in the reference frame of the MTS transmitter. A computer translates the position and orientation state of the MTS receiver in order to calculate the position of the digitizer tip in the reference frame of the MTS transmitter. Specifically, a computer calculates the position of the digitizer tip using the following equation.

$$r_{tip,tx,tx}=r_{rx,tx,tx}+C_{rx,tx}r_{tip,rx,rx} \quad \text{(Equation 1)}$$

where (i) $r_{tip,tx,tx}$ is a vector from the MTS transmitter to digitizer tip, in the reference frame of the MTS transmitter, (ii) $r_{rx,tx,tx}$ is a vector from the MTS transmitter to the MTS receiver, in the reference frame of the MTS transmitter, (iii) $r_{tip,rx,rx}$ is a vector from the MTS receiver to the digitizer tip, in the reference frame of the MTS receiver, and (iv) $C_{rx,tx}$ is the 3D rotation matrix that rotates the frame of reference of the MTS transmitter to the frame of reference of the MTS receiver. In some cases, this rotation matrix $C_{rx,tx}$ is calculated from an orientation quaternion given by the tracking system.

In some cases, the MTS comprises a Polhemus FASTRAK™ system, which is an AC 6D magnetic tracking system. In some cases, the Polhemus™ MTS is configured to output the orientation of the MTS receiver as a quaternion.

In illustrative implementations, the print mode allows the user to print a selected shape (e.g., a surface object in Rhinoceros™) on a physical object (the workpiece). In some cases: (a) the print mode is activated by pressing the print button; (b) there are two microswitches on the handset, which are used to override computer control of the inkjet print head; (c) the first microswitch overrides the computer to fire all the nozzles regardless of whether the computer pattern requires ink at the nozzle position or not; and (d) the second microswitch overrides the computer to not fire any nozzle.

In illustrative implementation, when the handheld printer is operating in printing mode, a computer computes the trajectories of all the nozzles on the print head for each position frame reported by the tracking system. When the intersection distance for a nozzle trajectory is within a certain threshold the computer sends commands to the print head to trigger the nozzle.

In illustrative implementations, an inkjet printer shoots droplets of ink by piezoelectric or thermoelectric actuation through nozzles mounted on a unit commonly called the inkjet print head (or sometimes called an inkjet cartridge). One of the major advantages of this printing technology is that the ink droplets may be fired from a distance from the workpiece, allowing the printer to print without having to make mechanical contact with the workpiece.

In some cases, a user employs the handheld printer in the following workflow: (1) The user uses the digitizer tip to create a pointcloud for the features of interest of the workpiece. (2) The pointcloud data is used to generate a CAD or partial CAD model. Because the point-cloud data is specified in the reference frame of MTS transmitter, the CAD model of the object is in proper registration with this reference system. (3) A computer performs CAD operations on the computer model. (4) The results of the CAD operations are transferred to the object using print mode.

3D Computer Model/Printing on 3D Curved Surface

In illustrative implementations, data representing a model of a curved 3D surface of a workpiece is stored in electronic memory. The curved surface may be represented in different ways. For example, in some cases, the curved surface is represented by B-Splines (basis splines) or by NURBS (non-uniform rational B-spline).

In some implementations, the target pattern comprises sections of the surface of the work piece. The sections divide the work piece surface into parts that are intended to receive ink (print area) and parts that are not intended to receive ink. A computer calculates the nozzle trajectories for each nozzle on the inkjet print head based on the position and orientation estimate of the handheld with respect to the work piece. Whether a nozzle is fired or not depends on whether the intersection point for the nozzle trajectory lies within a print or no-print section of the surface.

In some implementations, the work piece surface is represented as a 3D mesh. The target pattern to be printed comprises a single 2D image or multiple 2D images that are texture mapped onto the work piece surface. This mapping may be achieved in different ways. For example, in some cases, a computer performs UV mapping to map the target pattern to the 3D. The UV mapping includes mapping a set of orthogonal parameters on the surface wire mesh to X,Y pixels of the target image.

In some implementations, a computer performs a computation that starts with a nozzle trajectory intersection point with the curved surface of the workpiece, then reverse maps to find the corresponding pixel-color value for the intersection point, and then determines whether the corresponding nozzle should be fired or not. In some cases, after a nozzle is fired, the corresponding pixel data in the target image is updated. This data is used to determine whether the area has already been printed on or not.

In some implementations, the printing system calculates a 3D point-cloud of a curved surface of the work piece based on magnetic tracking sensor measurements that are taken while a digitizer tip of a handheld printer is moved along the surface. A computer fits the 3D point-cloud to a NURBS 3D model in a 3D surface modeling software (e.g., Rhinoceros™). The target pattern is created by the user within Rhinoceros™ as a set of NURBS surfaces. The handheld printer prints on the surface.

In some cases, a computer accesses the stored data, revises the 3D model, and causes data that represents the revised 3D model to be stored again in electronic memory. In some cases, a computer takes data indicative of a 3D model of the curved surface as input, and outputs control signals for controlling printing by nozzles of a inkjet print head onboard the handheld printer.

In some cases, a computer fits a 3D computer model to the point-cloud for a more complete representation of the work piece. For example, in an illustrative use scenario: (a) A user intends to print a pattern on a curved physical object. (B) The pattern would be, when printed, a projection of a 2D pattern unto a surface of the physical object. (C) The user has the physical object itself, but there does not exist a CAD model for the physical object. (D) An MTS measures the position of points on the surface while the user moves a digitizer tip of a handheld printer to different positions on the surface, and a computer uses these measurements to compute a 3D point-cloud for a physical object. The physical object is fixed or mounted in position in the workspace. (E) A computer fits a model of a sphere (e.g., with a center at x,y,z and radius r) to the point-cloud using the least squares method. (F) The computer then projects a 2D pattern onto the sphere surface. (G) The computer than controls firing of nozzles in the print head, in order to cause a projection of the 2D pattern onto the surface to be printed on the surface.

In some cases, a computer uses the point cloud to estimate the position of the work piece in the reference frame of the tracking system. The computer does so by best fitting an already existing computer model for the work piece to the point-cloud data. For example, in an illustrative use scenario: (A) A user intends to use an existing 3D model to print on a work piece, but the position of (registration for) the work piece has shifted. (B) In order to re-establish registration, the user uses the digitizer tip to collect point-cloud data for the work piece. (C) A calculator uses the point-cloud data as input, in order to compute registration parameters (e.g., translation: x, y, z; orientation: three Euler angles).

In some cases: (i) the digitizer tip is used to measure features on the work piece; (ii) data indicative of these features are then added to the computer model; and (iii) these features are then used to further revise the computer model. For example, in an illustrative use scenario: (A) A user prints a design on a curved surface of a physical bowl. (B) The physical bowl is mounted rigidly in the workspace. Thus, the bowl is in registration with respect to the computer model of the design and of the object. (C) The user drills a hole in the bowl. (D) An MTS takes measurements of the position of points in the hole when the user positions the digitizer tip at the hole. (E) A computer takes the measurements as input and calculates data that represents a set of one or more points in the hole. (F) The computer uses this data to revise a computer model of the bowl, such that the hole is added to the computer model of the bowl. (G) At the user's instruction, the computer uses the position of the hole to anchor a design that goes around the hole.

In some implementations: (a) the digitizer tip is used to create a point cloud that represents the position of points on a curved surface of a workpiece; and (b) a computer fits a computer model to the point-cloud. This makes the design more editable. In an illustrative use scenario: (A) A point-cloud for a bowl has been calculated. (B) To facilitate this calculation, a computer fits a hemisphere to the point-cloud. (C) This allows a computer to computationally attach a pattern/design to the base, by placing a circular design pattern in a plane normal to the axis of the hemisphere, to center the pattern to the axis of the hemisphere, and then project to project the pattern onto the hemisphere. (D) These calculations using the hemisphere are far simpler than the calculations that would be required to perform these operations on a point cloud. Thus, in some implementations, the digitizer tip allows the user to create designs for the work piece in proper registration with the natural geometric features of the work piece.

In some implementations, a computer calculates the orientation and position of the handheld printer with respect to the tracking system transmitter. In one embodiment the position of each nozzle is computed using the following equation.

$$r_{nozzle,tx}=r_{rx,tx}+r_{nozzle,rx} \quad \text{(Equation 2)}$$

where (i) $r_{nozzle,tx}$ is a vector from the MTS transmitter to the nozzle, (ii) $r_{rx,tx}$ is a vector from the MTS transmitter to the MTS receiver, and (iii) $r_{nozzle,rx}$ is a vector from the MTS receiver to the nozzle.

In some implementations, the vector $r_{nozzle,rx}$ is determined during calibration, as described in more detail below. For each nozzle, a nozzle trajectory ray is computed starting at the position of the nozzle as computed above.

In some implementations, the most time consuming computation is the nozzle ray intersection with the 3D object representation, to determine if the nozzle needs to be fired and to determine the ink value for the location. In a prototype of this invention, a mesh representation allows realtime performance on medium mesh sizes (about 1000 triangles).

In some implementations of this invention, the order in which a computer searches the mesh triangles is based on the previous calculated nozzle ray intersection(s). For example, after a mesh triangle for the first nozzle ray intersection is calculated (a "first triangle"), the computer may search mesh triangles adjacent to the first triangle when searching for the second nozzle ray intersection. In many cases, this alternative approach this would lead to the triangle search stopping within the first few mesh triangles, thereby speeding up the overall computation for trajectory mesh intersections over all the nozzles. Alternatively, a computer searches for the nozzle-triangle intersection over all triangles separately for each nozzle. Alternatively, in some cases, nozzle ray intersection is calculated with UV mapped textures. In some cases, a GPU (Graphics Processor Unit) speeds up computations, including nozzle ray intersection calculations. For example, in some cases, algorithms are written with libraries such as CUDA (Compute Unified Device Architecture) that employ a GPU to perform computations.

Spatial Coordinate Systems

As used herein, a "reference frame" is a spatial coordinate system.

In some implementations of this invention, a computer employs two reference frames during computations: (1) the reference frame of the MTS transmitter; and (2) the reference frame of the MTS receiver.

The first reference frame is the reference frame of the MTS transmitter (also called the ground reference frame). In the first reference frame, the MTS transmitter is in a fixed position relative to the reference frame. This first reference frame is used for computer models of (i) the design to be printed and (ii) the curved surface of the workpiece. This first reference frame is also used to describe (i) the position and orientation of the nozzles and (ii) the position and orientation of the handheld printer.

The second reference frame is the reference frame of the MTS receiver. In this second reference frame, the MTS receiver is in a fixed position relative to the reference frame. This second reference frame moves with the handheld printer. The nozzle-receiver vectors ($r_{nozzle,rx}$) and the nozzle direction vectors (which each, respectively, indicate a direction in which a nozzle is pointed, relative to the handheld printer) are each described in this second reference frame because they do not change, regardless of the orientation of the handset relative to the outside world.

In some implementations of this invention, the position of each nozzle is obtained in the reference frame of the transmitter for each position-orientation returned by the tracking system using the following equation:

$$r_{nozzle,tx,tx}=r_{rx,tx,tx}+C_{rx,tx}r_{nozzle,rx,rx} \quad \text{(Equation 3)}$$

where (i) $r_{nozzle,tx,tx}$ is a vector from the MTS transmitter to the nozzle tip, in the reference frame of the MTS transmitter, (ii) $r_{rx,tx,tx}$ is a vector from the MTS transmitter to the MTS receiver, in the reference frame of the MTS transmitter, (iii) $r_{nozzle,rx,rx}$ is a vector from the MTS receiver to the nozzle tip, in the reference frame of the MTS receiver, and (iv) $C_{rx,tx}$ is the 3D rotation matrix that rotates the frame of reference of the MTS transmitter to the frame of reference of the MTS receiver.

Calibration

In illustrative implementations, the quality of the print depends not only on the accuracy of the tracking system but also on the accuracy of the estimate of the position vector from the MTS tracking sensor (which is onboard the handheld printer) to each nozzle on the inkjet print head (which is also onboard the handheld printer). Thus, is desirable to determine a position vector for each nozzle with respect to the MTS receiver. (As described above, this position vector is one of two vectors that are added, in order to calculate the position and orientation of each nozzle in the global reference frame. See Equations 2 and 3 above).

In illustrative implementations, this position vector (of each nozzle with respect to the MTS receiver) is determined by calibration. The calibration process includes both an initial coarse calibration and a later fine calibration.

In the coarse calibration, a computer calculates a rough estimate of the offset (position vector) for each nozzle partly from the CAD model of the handheld printer and partly from a high-resolution photograph of the model. The objective of coarse calibration is to bootstrap the system to work so as to allow for collection of data for a finer calibration.

The CAD model is not sufficient to create an accurate estimate of the offset for each nozzle, because the actual physical offset may vary from the CAD model due to manufacturing tolerances.

In the fine calibration, a more accurate estimate of the offset for each nozzle is calculated.

In some implementation, the following procedure is used for the fine calibration. An advantage of this procedure is that it is simple enough and quick enough to be done by the user for a new print head or each time that an inkjet cartridge is changed.

The objective of fine calibration is to fine tune the X,Y components of the nozzle offset vector. However, as the components cannot be directly measured, the fine calibration procedure is designed to isolate the error in the offset vector along the X and Y components. The technique relies on the fact that if the handset is used while being kept parallel to either of the coordinate axes, the resulting printed image is displaced by the error in the nozzle unit vectors along the axis. However, due to a lack of an absolute reference frame on the paper, this displacement cannot be measured directly. Printing another image using the handset in the exact opposite orientation (by rotating 180 degrees) produces another displaced image. The total displacement between the images is twice the offset correction that needs to be applied. To collect the calibration data, the printhead prints the two parallel lines. The calibration print is then scanned and the displacement between broken line segments is estimated to compute the X and Y components of the correction.

Proximity Sensor and Distance Feedback

In some implementations of this invention, a proximity sensor takes measurements. A computer takes the measurements as input and estimates distance of the handheld printer from the work piece. The computer outputs control signals that cause a visual or haptic transducer to convey, to the user, information regarding the distance between the handheld printer and the work piece.

In some implementations, the proximity sensor is used to help a user deal with the visual occlusion of the workpiece by the handheld printer. (That is, the visual occlusion due to the handheld printer blocking a portion of the user's view of the workpiece). For example, in some cases, a proximity sensor that emits infrared light takes measurements that are used to estimate the distance of the handheld printer from the workpiece at the point at which ink is being applied. In addition, in some cases, the proximity sensor gathers data that is added to a computer model of the workpiece. For example, in one use scenario, a computer model for the workpiece lacks local detail, and measurements taken by the proximity sensor are used to add local detail.

Other Embodiments

This invention may be implemented in many different ways.

For example, in some implementations, the handheld inkjet printer is mounted with inertial sensors (e.g., accelerometers, gyroscope, and magnetometer). Thus, the inertial sensors measure user gestures that the user makes while holding the handheld printer. Data representing these measurements is sent to a computer. Based on this data, the computer dynamically changes the local raster pattern where the printer is currently printing. In an illustrative use case, a user artistically modifies a target pattern by making gestures that cause a computer to modify a local raster pattern.

This invention is not limited to using a magnetic tracking sensor (MTS). Other sensors may be used to detect the position and orientation of the handheld printer. In some cases, the position and orientation of the handheld device is detected by a mechanical linkage system with 6 or more degrees of freedom where the rotation of each joint is accurately measured using a high-resolution encoder. A problem, however, with the mechanical linkage approach is that this may mechanically restrain the user's freedom of movement when moving the handheld printer.

In some implementations of this invention, the position and orientation of the handheld printer is detected by one or more cameras. The cameras are external to, and separate from, the handheld printer. In some cases, each external camera, respectively, is located in a fixed position. In some cases, the external cameras optically track the 3D position and orientation of the handheld printer, by optically tracking the position of one or more visual features on the handheld printer. Each of these visual features is affixed to or part of an external surface of the handheld printer. In some cases, the external cameras perform optical tracking with three or more degrees of freedom (DOF), such as three DOF or six DOF.

Figure 14:
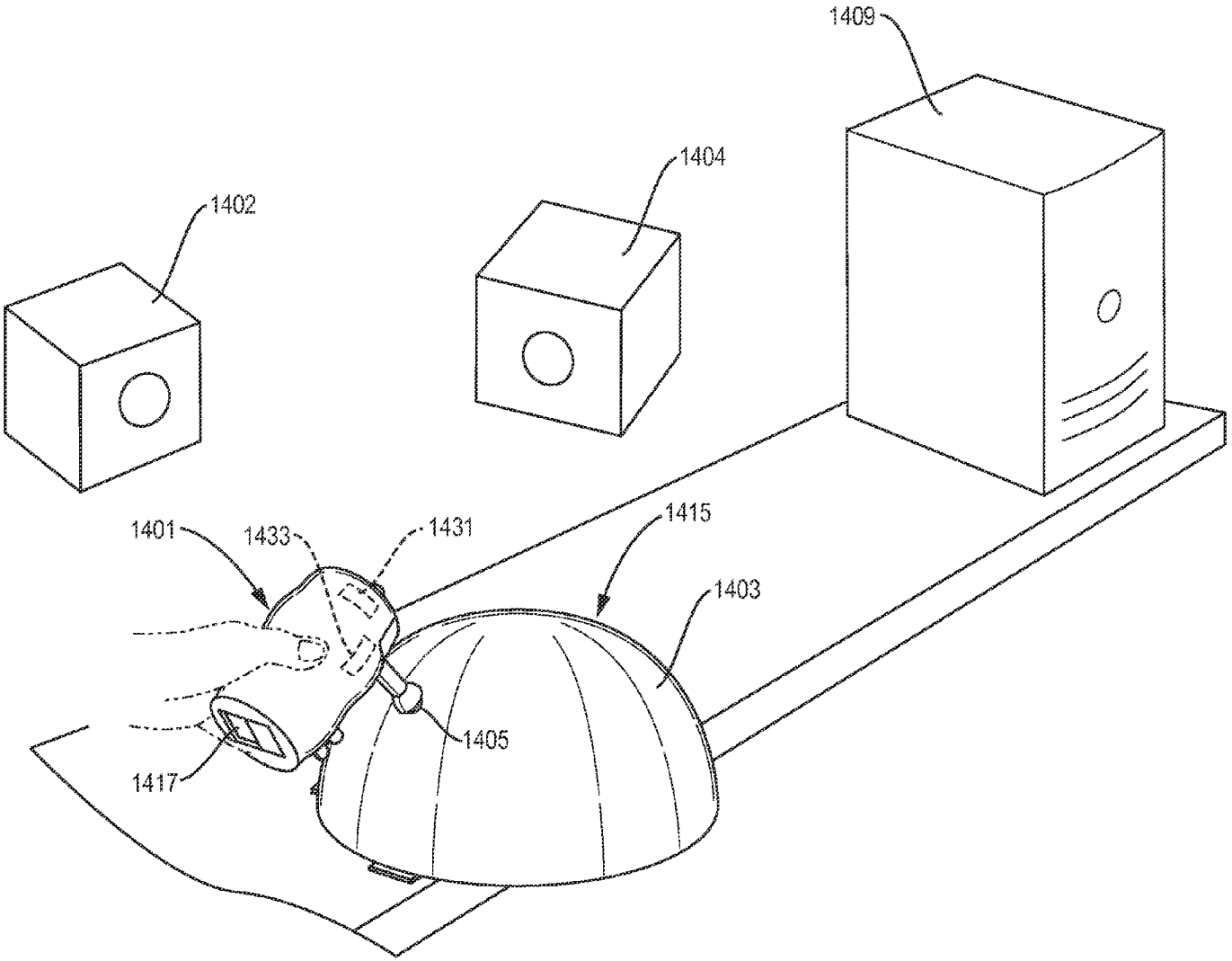
FIG. 14 shows two cameras tracking the position of visual targets on a handheld printer.

FIG. 14 shows two cameras 1402, 1404, tracking the position of visual targets 1431, 1433 on a handheld printer 1401, in an illustrative implementation of this invention. Calibration data has been stored in electronic memory in computer 1409. The calibration data includes data regarding: (i) the position of the visual targets 1431, 1433 relative to a digitizer tip 1405 of the handheld printer 1401; and (ii) the position of each nozzle, respectively, in print head 1417 relative to one or more of the visual targets (e.g., 1431, 1433) on the handheld printer or relative to a digitizer tip 1405 of the handheld printer. Visual data captured by the two cameras 1402, 1404 is sent to computer 1409. Computer 1409 takes the visual data and the calibration data as inputs, in order to calculate the position and orientation of the handheld printer 1401.

In the example shown in FIG. 14, a user is moving the handheld printer relative to a curved surface 1403 of workpiece 1415, while the digitizer tip 1405 of the handheld printer is pressed against, and moving along, the curved surface 1403. Cameras 1402, 1404 track the position of two or more of the visual features (e.g., 1431, 1433), and thus (because the position of the visual features relative to the digitizer tip is known) measure the position of the digitizer tip 1405 and of points on the curved surface 1403 that are touched by the digitizer tip 1405.

In illustrative implementations, a user occasionally moves the handheld printer such that one or more visual tags are temporarily visually occluded (not in line of sight of the external cameras). In order to mitigate this problem of visual occlusion, one or more additional sensors may be used to measure displacement of the handheld printer relative to the workpiece. For example, the additional sensors may, in some cases, comprise a combination of one or more accelerometers, gyroscopes, IMUs (inertial measurement units), optical flow sensors, and (if the handheld printer has wheels) rotary encoders. A computer takes measurements by these additional sensors as input and performs a state estimation algorithm (e.g., a Kalman filter) to iteratively estimate position and orientation of the handheld printer, even when one or more visual tags on the handheld printer are occluded.

In some cases: (a) one or more sensors measure a certain physical quality of the work piece; and (b) the raster pattern for a particular location is dynamically and locally updated with the sensor information. For example, in some implementations, a surface scanner mounted on the handheld printer, and data gathered by the surface scanner is used by the computer to modify the raster pattern. For example, in some use scenarios, data gathered from the surface scanner is used to update the raster pattern, such that the resulting printed pattern makes surface imperfections more evident by printing annotations on the imperfections.

This invention may be implemented with a wide variety of kinds of ink for the print head. For example, in some cases, the nozzles eject: (a) colored water-based ink; (b) other solvent-based ink; (c) conductive ink (such as inks that include suspended silver or copper particles); or (d) inks that react within themselves or potentially with the surface of the workpiece when deposited on the surface of the workpiece.

Computers

In exemplary implementations of this invention, one or more electronic computers (e.g., 109, 169, 187, 1409) are programmed and specially adapted: (1) to control the operation of, or interface with, hardware components of a printing system, including a print head, an absolute position sensor system (e.g., a magnetic tracking system or optical tracking system), and optionally one or more other sensors located onboard the handheld printer, including an optical flow meter, an accelerometer, a gyroscope, an infrared proximity sensor, or a surface scanner; (2) to calculate a point cloud that represents points on a surface; (3) to modify, based on the point cloud, a CAD model; (4) to calculate position and orientation of a nozzle of a print head relative to a surface;

(5) to calculate an intersection of a nozzle ray with a surface; (6) to control firing or operation of nozzles in a print head; (7) to cause a handheld printer to print a pattern on a surface; (8) to perform calibration, including calibration to determine a position vector of a nozzle in a print head relative to a MTS tracking sensor; (9) to perform any other calculation, computation, program, algorithm, computer function or computer task described or implied above; (10) to receive signals indicative of human input; (11) to output signals for controlling transducers for outputting information in human perceivable format; and (12) to process data, to perform computations, to execute any algorithm or software, and to control the read or write of data to and from memory devices. The one or more computers may be in any position or positions within or outside of the printing system. For example, in some cases (a) at least one computer is housed in or together with other components of the printing system; and (b) at least one computer is remote from other components of the printing system. The one or more computers are connected to each other or to other components in the printing system either: (a) wirelessly, (b) by wired connection, or (c) by a combination of wired and wireless links.

In exemplary implementations, one or more computers are programmed to perform any and all calculations, computations, programs, algorithms, computer functions and computer tasks described or implied above. For example, in some cases: (a) a machine-accessible medium has instructions encoded thereon that specify steps in a software program; and (b) the computer accesses the instructions encoded on the machine-accessible medium, in order to determine steps to execute in the program. In exemplary implementations, the machine-accessible medium comprises a tangible non-transitory medium. In some cases, the machine-accessible medium comprises (a) a memory unit or (b) an auxiliary memory storage device. For example, in some cases, a control unit in a computer fetches the instructions from memory.

In illustrative implementations, one or more computers execute programs according to instructions encoded in one or more tangible, non-transitory, computer-readable media. For example, in some cases, these instructions comprise instructions for a computer to perform any calculation, computation, program, algorithm, computer function or computer task described or implied above. For example, in some cases, instructions encoded in a tangible, non-transitory, computer-accessible medium comprise instructions for a computer to: (1) to control the operation of, or interface with, hardware components of a printing system, including an absolute position sensor system (e.g., a magnetic tracking system or optical tracking system), and optionally one or more other sensors located onboard the handheld printer, including an optical flow meter, an accelerometer, a gyroscope, an infrared proximity sensor, or a surface scanner; (2) to calculate a point cloud that represents points on a surface; (3) to modify, based on the point cloud, a CAD model; (4) to calculate position and orientation of a nozzle of a print head relative to a surface; (5) to calculate an intersection of a nozzle ray with a surface; (6) to control firing or operation of nozzles in a print head; (7) to cause a handheld printer to print a pattern on a surface; (8) to perform calibration, including calibration to determine a position vector of a nozzle in a print head relative to a MTS tracking sensor; (9) to perform any other calculation, computation, program, algorithm, computer function or computer task described or implied above; (10) to receive signals indicative of human input; (11) to output signals for controlling transducers for outputting information in human perceivable format; and (12) to process data, to perform computations, to execute any algorithm or software, and to control the read or write of data to and from memory devices.

Network Communication

In illustrative implementations of this invention, an electronic device (e.g., 107, 109, 117, 167, 169, 171, 173, 187, 1409) is configured for wireless or wired communication with other electronic devices in a network.

For example, in some cases, a computer and components of a position sensing system (e.g., external video cameras for an optical tracking system or an MTS transmitter and MTS transmitter for a magnetic tracking system) are each operatively connected to a wireless communication module for wireless communication with other electronic devices in a network. Each wireless communication module (e.g., 141, 143, 145, 147) includes (a) one or more antennas, (b) one or more wireless transceivers, transmitters or receivers, and (c) signal processing circuitry. The wireless communication module receives and transmits data in accordance with one or more wireless standards.

In some cases, one or more of the following hardware components are used for network communication: a computer bus, a computer port, network connection, network interface device, host adapter, wireless module, wireless card, signal processor, modem, router, computer port, cables or wiring.

In some cases, one or more computers (e.g., 109, 169, 187, 1409) are programmed for communication over a network. For example, in some cases, one or more computers are programmed for network communication: (a) in accordance with the Internet Protocol Suite, or (b) in accordance with any other industry standard for communication, including any USB standard, ethernet standard (e.g., IEEE 802.3), token ring standard (e.g., IEEE 802.5), wireless standard (including IEEE 802.11 (wi-fi), IEEE 802.15 (bluetoothhigbee), IEEE 802.16, IEEE 802.20 and including any mobile phone standard, including GSM (global system for mobile communications), UMTS (universal mobile telecommunication system), CDMA (code division multiple access, including IS-95, IS-2000, and WCDMA), or LTS (long term evolution)), or other IEEE communication standard.

Definitions

The terms "a" and "an", when modifying a noun, do not imply that only one of the noun exists.

"CAD" means computer-assisted design.

Non-limiting examples of "to calculate" include: (a) to perform a computation that generates a set of data; (b) to perform a computation that modifies a set of data, and (c) to retrieve a set of data from memory.

To calculate "based on" specified data means to perform a computation that takes the specified data as an input.

The term "comprise" (and grammatical variations thereof) shall be construed as if followed by "without limitation". If A comprises B, then A includes B and may include other things.

The term "computer" includes any computational device that performs logical and arithmetic operations. For example, in some cases, a "computer" comprises an electronic computational device, such as an integrated circuit, a microprocessor, a mobile computing device, a laptop computer, a tablet computer, a personal computer, or a mainframe computer. In some cases, a "computer" comprises: (a) a central processing unit, (b) an ALU (arithmetic logic unit), (c) a memory unit, and (d) a control unit that controls actions of other components of the computer so that encoded steps of a program are executed in a sequence. In some cases, a "computer" also includes peripheral units including an auxiliary memory storage device (e.g., a disk drive or flash memory), or includes signal processing circuitry. However, a human is not a "computer", as that term is used herein.

A "computer model" means a set of data that is generated, modified, read or readable by a computer and that represents or otherwise models an (i) object, (ii) surface, (iii) process, (iv) event or (iv) other thing. Non-limiting examples of a "computer model" include: (a) a set of data that represents a 3D surface or a 3D object; and (b) a CAD model.

"Defined Term" means a term or phrase that is set forth in quotation marks in this Definitions section.

For an event to occur "during" a time period, it is not necessary that the event occur throughout the entire time period. For example, an event that occurs during only a portion of a given time period occurs "during" the given time period.

The term "e.g." means for example.

The fact that an "example" or multiple examples of something are given does not imply that they are the only instances of that thing. An example (or a group of examples) is merely a non-exhaustive and non-limiting illustration.

To "fire" a nozzle means to eject ink from the nozzle.

Unless the context clearly indicates otherwise: (1) a phrase that includes "a first" thing and "a second" thing does not imply an order of the two things (or that there are only two of the things); and (2) such a phrase is simply a way of identifying the two things, respectively, so that they each may be referred to later with specificity (e.g., by referring to "the first" thing and "the second" thing later). For example, unless the context clearly indicates otherwise, if an equation has a first term and a second term, then the equation may (or may not) have more than two terms, and the first term may occur before or after the second term in the equation. A phrase that includes a "third" thing, a "fourth" thing and so on shall be construed in like manner.

The term "for instance" means for example.

As used herein, "handset" means an object that is configured to be held in a hand. A non-limiting example of a "handset" is a handheld inkjet printer.

"Herein" means in this document, including text, specification, claims, abstract, and drawings.

As used herein: (1) "implementation" means an implementation of this invention; (2) "embodiment" means an embodiment of this invention; (3) "case" means an implementation of this invention; and (4) "use scenario" means a use scenario of this invention.

The term "include" (and grammatical variations thereof) shall be construed as if followed by "without limitation".

Sensor measurements "indicate" x if the measurements directly measure x or if the measurements measure a feature, other than x, from which x is calculated.

"I/O device" means an input/output device. For example, an I/O device includes any device for (a) receiving input from a human, (b) providing output to a human, or (c) both. For example, an I/O device includes a user interface, graphical user interface, keyboard, mouse, touch screen, microphone, handheld controller, display screen, speaker, or projector for projecting a visual display. Also, for example, an I/O device includes any device (e.g., button, dial, knob, slider or haptic transducer) for receiving input from, or providing output to, a human.

"Magnetic sensor" means a sensor for measuring the magnitude or orientation of a magnetic field.

A "measurement" of x means (i) a direct measurement of x or (ii) a measurement of a feature, other than x, from which x is calculated.

To "multiply" includes to multiply by an inverse. Thus, to "multiply" includes to divide.

The term "or" is inclusive, not exclusive. For example A or B is true if A is true, or B is true, or both A or B are true. Also, for example, a calculation of A or B means a calculation of A, or a calculation of B, or a calculation of A and B.

A parenthesis is simply to make text easier to read, by indicating a grouping of words. A parenthesis does not mean that the parenthetical material is optional or may be ignored.

As used herein, the term "set" does not include a group with no elements. Mentioning a first set and a second set does not, in and of itself, create any implication regarding whether or not the first and second sets overlap (that is, intersect).

"Some" means one or more.

As used herein, a "subset" of a set consists of less than all of the elements of the set.

"Substantially" means at least ten percent. For example: (a) 112 is substantially larger than 100; and (b) 108 is not substantially larger than 100.

The term "such as" means for example.

"3D" means three-dimensional.

A "3D curved surface" means a surface such that, in a 3D Cartesian coordinate system: (i) a projection of a first region of the surface unto the xy plane is curved; (ii) a projection of a second region of the surface unto the yz plane is curved; and (iii) a projection of a third region of the surface unto the xz plane is curved, where the first, second or third regions may, but do not necessarily, overlap with each other in whole or in part.

As used herein, "tip" means a protuberance.

To say that a machine-readable medium is "transitory" means that the medium is a transitory signal, such as an electromagnetic wave.

Except to the extent that the context clearly requires otherwise, if steps in a method are described herein, then the method includes variations in which: (1) steps in the method occur in any order or sequence, including any order or sequence different than that described; (2) any step or steps in the method occurs more than once; (3) different steps, out of the steps in the method, occur a different number of times during the method, (4) any combination of steps in the method is done in parallel or serially; (5) any step or steps in the method is performed iteratively; (6) a given step in the method is applied to the same thing each time that the given step occurs or is applied to different things each time that the given step occurs; or (7) the method includes other steps, in addition to the steps described.

This Definitions section shall, in all cases, control over and override any other definition of the Defined Terms. For example, the definitions of Defined Terms set forth in this Definitions section override common usage or any external dictionary. If a given term is explicitly or implicitly defined in this document, then that definition shall be controlling, and shall override any definition of the given term arising from any source (e.g., a dictionary or common usage) that is external to this document. If this document provides clarification regarding the meaning of a particular term, then that clarification shall, to the extent applicable, override any definition of the given term arising from any source (e.g., a dictionary or common usage) that is external to this document. To the extent that any term or phrase is defined or clarified herein, such definition or clarification applies to any grammatical variation of such term or phrase, taking into account the difference in grammatical form. For example, the grammatical variations include noun, verb, participle, adjective, and possessive forms, and different declensions, and different tenses. In each case described in this paragraph, Applicant is acting as Applicant's own lexicographer.

Variations

This invention may be implemented in many different ways. Here are some non-limiting examples:

In one aspect, this is a system comprising: (a) a handset that includes an inkjet print head and a tip; (b) one or more sensors for (i) taking a first set of measurements of position of points that are on a curved surface and that are physically touched by the tip while the tip moves relative to the curved surface, and (ii) taking a second set of measurements of position and orientation of one or more nozzles in the print head, while the handset moves relative to the curved surface; and (c) one or more computers for (i) calculating, based on the first set of measurements, a computer model that specifies at least (A) position of the curved surface, and (B) a region of the curved surface on which a pattern is to be printed; and (ii) calculating, based on the computer model and the second set of measurements, which of the one or more nozzles to fire at different times to print the pattern on the region as the handset is moved relative to the curved surface. In some cases, the calculating in (c)(ii) of the first sentence of this paragraph includes determining which of the one or more nozzles is within a specified distance from the curved surface. In some cases, the calculating in (c)(ii) of the first sentence of this paragraph includes determining, for each respective nozzle, whether the respective nozzle is in a position and orientation relative to the curved surface, such that if ink were ejected from the respective nozzle, the ink would impact a point in the region. In some cases, the one or more sensors include a magnetic sensor. In some cases, the one or more sensors include a set of multiple cameras that are external to, and separate from, the handset. In some cases, the set of cameras is configured to track the position one or more visual features, each of which visual features, respectively, is affixed to or part of an external surface of the handset. Each of the cases described above in this paragraph is an example of the system described in the first sentence of this paragraph, and is also an example of an embodiment of this invention that may be combined with other embodiments of this invention.

In another aspect, this invention is an apparatus comprising: (a) one or more sensors; (b) a handset that includes a print head and a tip; and (c) one or more computers; wherein (i) the one or more sensors are configured (A) to take a first set of measurements while the tip is physically touching a 3D curved surface, which first set of measurements indicate the position of each point respectively in a set of points on the 3D curved surface, and (B) to take a second set of measurements that indicate the position and orientation of each nozzle, respectively, in a set of one or more nozzles in the print head, and (ii) the one or more computers are programmed (A) to generate or modify a computer model of the 3D curved surface, based at least in part on the first set of measurements, (B) to calculate a target region on which a pattern is to be printed, which target region is a region of the 3D curved surface, and (C) to perform a computation that takes as input the second set of measurements and the computer model and that involves, for each respective nozzle in the set of one or more nozzles (I) making a determination whether (x) the respective nozzle is in a position and orientation relative to the 3D curved surface, such that if ink were ejected from the respective nozzle, the ink would impact a point in the target region, and (y) the distance from the respective nozzle to the point is less than a threshold distance, and (II) based at least in part on the determination, outputting one or more signals to control whether the respective nozzle ejects ink. In some cases, the one or more computers are programmed to repeat the computation in section (ii)(C) of the first sentence of this paragraph for each of multiple locations of the handset, while the handset is moved relative to the 3D curved surface. In some cases, the one or more sensors include a magnetic sensor. In some cases: (a) the magnetic sensor comprises a transmitter and a receiver; and (b) the receiver is housed in or affixed to the handset. In some cases, the one or more sensors include a set of multiple cameras that are external to, and separate from, the handset. In some cases, the handset includes an optical flow sensor for measuring changes in position of the optical flow sensor relative to the 3D curved surface. Each of the cases described above in this paragraph is an example of the apparatus described in the first sentence of this paragraph, and is also an example of an embodiment of this invention that may be combined with other embodiments of this invention.

In another aspect, this invention is a method comprising, in combination: (a) one or more sensors (i) taking a first set of measurements while a tip is physically touching a curved surface and is moving relative to the curved surface, which first set of measurements indicate the position of each point respectively in a set of points on the curved surface, and (ii) taking a second set of measurements that indicate the position and orientation of each nozzle, respectively, in a set of one or more nozzles in the print head; and (b) one or more computers (i) calculating, based on the first set of measurements, a computer model that specifies at least (A) position of the curved surface, and (B) a region of the curved surface on which a pattern is to be printed; and (ii) calculating, based on the computer model and the second set of measurements, which of the one or more nozzles to fire at different times to print the pattern on the region as the handset is moved relative to the curved surface. In some cases, at least one of the sensors is a magnetic sensor. In some cases: (a) the one or more sensors include a set of multiple cameras that are external to, and separate from, the handset; and (b) the set of cameras track the position one or more visual features, each of which visual features, respectively, is affixed to or part of an external surface of the handset. In some cases: (a) the tip includes a round object; and (b) the round object rotates as the tip is pressed against, and moved relative to, the curved surface. In some cases: (a) the handset includes multiple wheels; (b) the wheels rotate as the wheels are pressed against, and moved relative to, the curved surface; and (c) one or more rotary encoders measure rotation of one or more of the wheels. In some cases, the calculating in section (b)(ii) of the first sentence of this paragraph includes: (a) determining which of the one or more nozzles is within a specified distance from the surface; and (b) determining, for each respective nozzle in the one or more nozzles, whether the respective nozzle is in a position and orientation relative to the surface, such that if ink were ejected from the respective nozzle, the ink would impact a point in the region. In some cases, the one or more computers perform a state estimation algorithm to iteratively estimate position of a component of the handheld printer. In some cases: (a) the state estimation algorithm comprises a Kalman filter; and (b) a set of multiple iterations of the Kalman filter each include (i) an update step that takes as an input one or more measurements of absolute position of the component, and (ii) a propagation step takes as an input one or more measurements by a differential displacement sensor of position of the differential displacement sensor relative to the curved surface. Each of the cases described above in this paragraph is an example of the method described in the first sentence of this paragraph, and is also an example of an embodiment of this invention that may be combined with other embodiments of this invention.

The above description (including without limitation any attached drawings and figures) describes illustrative implementations of the invention. However, the invention may be implemented in other ways. The methods and apparatus which are described above are merely illustrative applications of the principles of the invention. Other arrangements, methods, modifications, and substitutions by one of ordinary skill in the art are therefore also within the scope of the present invention. Numerous modifications may be made by those skilled in the art without departing from the scope of the invention. Also, this invention includes without limitation each combination and permutation of one or more of the abovementioned implementations, embodiments and features.

What is claimed is:

1. A system comprising:

(a) a memory device for storing a first computer-assisted design model (CAD model) of a curved surface;

(b) a handset that includes an inkjet print head and a tip;

(c) one or more sensors for (i) taking a first set of measurements of position of points that are on the curved surface and that are physically touched by the tip while the tip moves relative to the curved surface, and (ii) taking a second set of measurements of position and orientation of one or more nozzles in the print head, while the handset moves relative to the curved surface; and (d) one or more computers for (i) calculating a 3D point cloud that represents the position of the points on the curved surface that were measured in the first set of measurements, (ii) calculating, based on the 3D point cloud and first CAD model, a second CAD model of the curved surface, such that the second CAD model is calculated before the second set of measurements is taken, and (iii) calculating, based on the second CAD model and the second set of measurements, which of the one or more nozzles to fire at different times to print the pattern on the region of the curved surface as the handset is moved relative to the curved surface.

2. The system of claim 1, wherein the one or more computers are programmed:

(a) to take a planar target pattern as an input and (b) to fit the planar pattern to a model of the curved surface.

3. The system of claim 1, wherein:

(a) the system includes an I/O device for accepting input, which input comprises an override instruction; and (b) the one or more computers are programmed to override, in response to the input, a mode of operation of the system such that (i) all of the nozzles fire, (ii) none of the nozzles fire, (iii) ink is reapplied to a region of the curved surface, or (iv) the system switches from a first pattern that determines nozzle firing to a second pattern that determines nozzle firing.

4. The system of claim 1, wherein:

(a) the one or more sensors include a magnetic sensor;

(b) the magnetic sensor comprises a transmitter and a receiver;

(c) the transmitter is an electromagnet that includes coils and is neither housed in nor affixed to the handset; and (d) the receiver includes coils and is housed in or affixed to the handset.

5. The system of claim 1, wherein calculating the second CAD model involves fitting the first CAD model to the 3D point cloud.

6. The system of claim 5, wherein:

(a) the one or more sensors include a set of multiple cameras that are external to, and separate from, the handset; and (b) the set of cameras is configured to track the position one or more visual features by capturing images of the visual features, each of which visual features, respectively, is affixed to or part of an external surface of the handset.

7. The system of claim 1, wherein:

(a) the one or more computers are programmed to perform a state estimation algorithm to iteratively estimate position of a component of the handset, (b) the state estimation algorithm comprises a Kalman filter; and (c) a set of multiple iterations of the Kalman filter each include (i) an update step that takes as an input one or more measurements of absolute position of the component, and (ii) a propagation step takes as an input one or more measurements by a differential displacement sensor of position of the differential displacement sensor relative to the curved surface.

8. An apparatus comprising:

(a) one or more sensors;

(b) a handset that includes a print head and a tip; and (c) one or more computers;

wherein (i) the one or more sensors are configured (A) to take a first set of measurements while the tip is physically touching a 3D curved surface, which first set of measurements indicate the position of each point respectively in a set of points on the 3D curved surface, and (B) to take a second set of measurements that indicate the position and orientation of each nozzle, respectively, in a set of one or more nozzles in the print head, and (ii) the one or more computers are programmed (A) to calculate a computer model that includes data regarding the position of the points on the 3D curved surface that were measured in the first set of measurements, (B) to calculate a target region on which a pattern is to be printed, which target region is a region of the 3D curved surface, and (C) to perform a computation that takes as input the second set of measurements and the computer model and that involves, for each respective nozzle in the set of one or more nozzles (I) making a determination whether (x) the respective nozzle is in a position and orientation relative to the 3D curved surface, such that if ink were ejected from the respective nozzle, the ink would impact a point in a target region of the 3D curved surface, and (y) the distance from the respective nozzle to the point is less than a threshold distance, and (II) based at least in part on the determination, outputting one or more signals to control whether the respective nozzle ejects ink.

9. The apparatus of claim 8, wherein calculating the computer model involves fitting a computer-assisted design model to a 3D point cloud, which point cloud comprises the data regarding the position of the points on the 3D curved surface that were measured in the first set of measurements.

10. The apparatus of claim 8, wherein:

(a) the one or more computers are programmed to perform a state estimation algorithm to iteratively estimate position of a component of the handset;

(b) the state estimation algorithm comprises a Kalman filter; and (c) a set of multiple iterations of the Kalman filter each include (i) an update step that takes as an input one or more measurements of absolute position of the component, and (ii) a propagation step takes as an input one or more measurements by a differential displacement sensor of position of the differential displacement sensor relative to the 3D curved surface.

11. The apparatus of claim 8, wherein:

(a) the one or more sensors include a magnetic sensor;

(b) the magnetic sensor comprises a transmitter and a receiver;

(c) the transmitter is an electromagnet that includes coils and is neither housed in nor affixed to the handset; and (d) the receiver includes coils and is housed in or affixed to the handset.

12. The apparatus of claim 8, wherein:

(a) the one or more sensors include a set of multiple cameras that are external to, and separate from, the handset; and (b) the set of cameras is configured to track the position one or more visual features by capturing images of the visual features, each of which visual features, respectively, is affixed to or part of an external surface of the handset.

13. The apparatus of claim 8, wherein the one or more computers are programmed to texture map a 2D image onto a 3D mesh representing the curved surface.

14. A method comprising, in combination:

(a) a memory device storing a first computer-assisted design model (CAD model) of a curved surface;

(b) one or more sensors taking a first set of measurements while a tip of a handset is physically touching a curved surface and is moving relative to the curved surface, which first set of measurements indicates the position of each point respectively in a set of points on the curved surface, which handset includes the tip and an inkjet print head, and which print head includes a set of one or more nozzles;

(c) one or more computers (i) calculating a 3D point cloud that represents the position of the points on the curved surface that were measured in the first set of measurements, and (ii) calculating, based on the 3D point cloud and the first CAD model, a second CAD model of the curved surface;

(d) the one or more sensors taking a second set of measurements that indicate the position and orientation of each nozzle, respectively, in the set of one or more nozzles, such that the second set of measurements is taken after the first set of measurements is taken; and (e) the one or more computers the curved surface on which a pattern is to be printed; and (ii) calculating, based on the second CAD model and the second set of measurements, which of the one or more nozzles to fire at different times to print a pattern on a region of the curved surface as the handset is moved relative to the curved surface.

15. The method of claim 14, wherein:

(a) the one or more sensors include a magnetic sensor;

(b) the magnetic sensor comprises a transmitter and a receiver;

(c) the transmitter is an electromagnet that includes coils and is neither housed in nor attached to the handset; and (d) the receiver includes coils and is housed in or affixed to the handset.

16. The method of claim 14, wherein:

(a) the one or more sensors include a set of multiple cameras that are external to, and separate from, the handset; and (b) the set of cameras track the position one or more visual features by capturing images of the visual features, each of which visual features, respectively, is affixed to or part of an external surface of the handset.

17. The method of claim 14, wherein the one or more computers calculate the second CAD model before the second measurements are taken.

18. The method of claim 14, wherein calculating the second CAD model involves fitting the first CAD model to the 3D point cloud.

19. The method of claim 14, wherein the calculating in section (d) of claim 14 includes:

(a) determining which of the one or more nozzles is within a specified distance from the surface; and (b) determining, for each respective nozzle in the one or more nozzles, whether the respective nozzle is in a position and orientation relative to the surface, such that if ink were ejected from the respective nozzle, the ink would impact a point in the region.

20. The method of claim 14, wherein:

(a) the one or more computers perform a state estimation algorithm to iteratively estimate position of a component of the handheld printer;

(b) the state estimation algorithm comprises a Kalman filter; and c a set of multiple iterations of the Kalman filter each include (i) an update step that takes as an input one or more measurements of absolute position of the component, and (ii) a propagation step takes as an input one or more measurements by a differential displacement sensor of position of the differential displacement sensor relative to the curved surface.

* * * * *